US005143824A

United States Patent [19]

Yamakawa et al.

[11] Patent Number: 5,143,824

[45] Date of Patent: Sep. 1, 1992

[54] SILVER HALIDE COLOR PHOTOGRAPHIC MATERIAL CONTAINING CYAN DYE-FORMING COUPLER

[75] Inventors: Katsuyoshi Yamakawa; Jiro Tsukahara, both of Kanagawa, Japan

[73] Assignee: Fuji Photo Film Co., Ltd., Kanagawa, Japan

[21] Appl. No.: 691,558

[22] Filed: Apr. 25, 1991

[30] Foreign Application Priority Data

Apr. 26, 1990 [JP] Japan ..... 2-111176

[51] Int. Cl.[5] ..... G03C 7/38

[52] U.S. Cl. ..... 430/558; 430/384; 430/385

[58] Field of Search ..... 430/384, 385, 558

[56] References Cited

FOREIGN PATENT DOCUMENTS

| | | | |
|---|---|---|---|
| 0362808 | 4/1990 | European Pat. Off. | 430/385 |
| 2-304437 | 12/1990 | Japan | 430/558 |
| 2-304438 | 12/1990 | Japan | 430/558 |
| 2-308248 | 12/1990 | Japan | 430/558 |

*Primary Examiner*—Lee C. Wright

*Attorney, Agent, or Firm*—Birch, Stewart, Kolasch & Birch

[57] ABSTRACT

A silver halide color photographic material comprising a support at least one photosensitive silver halide emulsion layer formed on said support, wherein said at least one photosensitive silver halide emulsion layer contains at least one cyan dye-forming coupler selected from the group consisting of compounds represented by the following general formula (I):

(I)

wherein $R^1$ represents an electron-donating group; $R^2$ represents a hydrogen atom, a substituted or unsubstituted aliphatic group, a substituted or unsubstituted aromatic group or a substituted or unsubstituted heterocyclic group; $R^3$ represents a substituent group; and n represents an integer of 0 to 2.

26 Claims, 1 Drawing Sheet

SILVER HALIDE COLOR PHOTOGRAPHIC MATERIAL CONTAINING CYAN DYE-FORMING COUPLER

FIELD OF THE INVENTION

The present invention relates to silver halide color photographic materials containing a novel cyan dye-forming coupler.

BACKGROUND OF THE INVENTION

When silver halide color photographic materials are subjected to color development after exposure, developing agents such as aromatic primary amines react with dye-forming couplers to form color images. In this method, the color images are generally often reproduced by the subtractive color process, and for the purpose of reproducing blue, green and red colors, yellow, magenta and cyan color images complementary to the respective colors are formed.

As cyan color image forming couplers, phenols and naphthols are frequently used. However, cyan dyes obtained from the phenols and naphthols conventionally used have side absorption in blue and green regions. In particular, this is undesirable for the color reproduction of green, and it is therefore desired to improve this disadvantage.

On the other hand, as couplers in which heteroatoms are introduced into rings having eliminable groups, 3-hydroxypyridine and 2,6-dihydroxypyridine are only disclosed in U.S. Pat. No. 2,293,004. The wavelength of an absorption obtained from 3-hydroxypyridine described in U.S. Pat. No. 2,293,004 is very short, and the absorption peak is also broad. Further, this 3-hydroxypyridine is water-soluble. For these reasons, 3-hydroxypyridine can not be used as the so-called cyan coupler.

On the other hand, 3-hydroxypyridine having an amido bond at the 2-position recently disclosed in European Patent 0,333,185 and JP-A-1-315736 (the term "JP-A" as used herein means an "unexamined published Japanese patent application") has a sharp absorption peak, and therefore an improvement in color reproduction is expected. However, its improvement effect is insufficient, and a coupler having a sharper wave form is desired under present conditions.

SUMMARY OF THE INVENTION

Accordingly, an object of the present invention is to provide a silver halide color photographic material containing a novel cyan dye-forming coupler excellent in absorption characteristics for the forming dye (namely, having no side absorption in blue and green regions, sharp in absorption wave form, and improved in color reproduction).

The objects of the present invention can be attained by the present invention described below.

Namely, the present invention provides a silver halide color photographic material containing at least one of the dye-forming couplers represented by the following general formula (I):

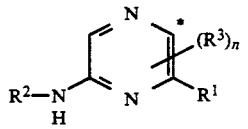

(I)

wherein $R^1$ represents an electron-donating group; $R^2$ represents a hydrogen atom, a substituted or unsubstituted aliphatic group, a substituted or unsubstituted aromatic group or a substituted or unsubstituted heterocyclic group; $R^3$ represents a substituent group; and n represents an integer of 0 to 2. (Explanation with respect to * can be seen hereinafter.)

DETAILED DESCRIPTION OF THE INVENTION

Figure 1:
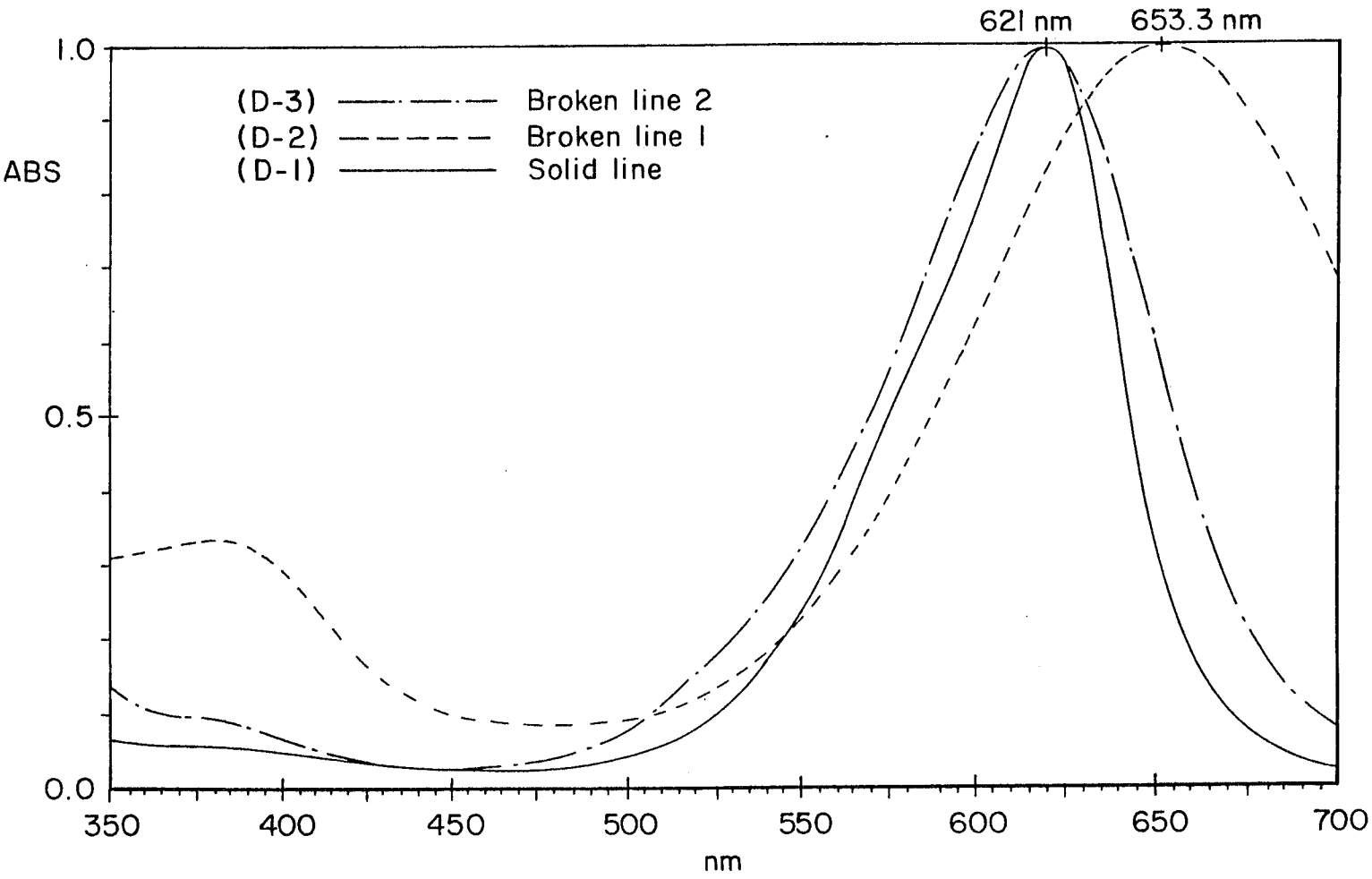
FIG. 1 is a graph showing the solution absorption (4) curve of azomethine dye D-1 obtained from coupler of the present invention and developing agent R, the solution absorption curve of dye D-2 obtained from coupler A for comparison and developing agent R, and the solution absorption curve of D-3 obtained from coupler (1) for comparison and developing agent R. The solid line indicates the absorption curve of dye D-1, the broken line 1 indicates the absorption curve of dye D-2 and the broken line 2 indicates the absorption curve of dye D-3.

The dye-forming couplers of the present invention will hereinafter be described in more detail.

In general formula (I), $R^1$ represents an electron-donating group, which is preferably a substituent group having a Hammett's substituent constant ($\sigma p$) of $-0.25$ or less, more preferably of $-0.50$ or less, and preverably not less than $-0.9$. Such a group is preferable in order to carry out a coupling reaction efficiently. As the values of the Hammett's substituent constant ($\sigma p$), it is preferred to use the values described in the reports of Hansch, C. Leo et al. [for example, *J. Med. Chem.* 16, 1207 (1973) and ibid. 20, 304 (1977)].

Examples of the substituent groups having a substituent constant ($\sigma p$) of $-0.25$ or less include the following groups:

i) An unsubstituted amino group and amino groups substituted with at least one of alkyl groups preferably having 1 to 30 carbon atoms (in the present invention the number of carbon atoms of a group includes the number of carbon atoms of the substituent(s) thereof), aryl groups preferably having 6 to 36 carbon atoms, and a hydroxy group, these substituents may be further substituted with at least one of the substituents selected from alkyl groups, alkoxy groups (for example, methoxy and 2-methoxyethoxy), aryloxy groups (for example, 2,4-di-tert-amylphenoxy, 2-chlorophenoxy and 4-cyanophenoxy), alkenyloxy groups (for example, 2-propenyloxy), amino groups (for example, butylamino, dimethylamino, anilino and N-methylanilino), aliphatic or aromatic acyl groups (for example, acetyl and benzoyl), ester groups, i.e., aliphatic or aromatic oxycarbonyl groups (for example, butoxycarbonyl, phenoxycarbonyl), aliphatic or aromatic acyloxy groups (for example, acetoxy and benzoyloxy), aliphatic or aromatic sulfonyloxy groups (for example, toluenesulfonyloxy), and aliphatic or aromatic oxysulfonyl groups (for example, butoxysulfonyl), amido groups (for example, acetylamino and methanesulfonamido), carbamoyl and thiocarbamoyl groups (for example, ethylcarbamoyl, dimethylcarbamoyl, and butylsulfamoyl), thioureido groups (for example, dipropylsulfamoylamino), imido groups (for example, succinimido and hydantoinyl), ureido groups (for example, phenylureido and dimethylureido), aliphatic or aromatic sulfonyl groups (for example, methanesulfonyl and phenylsulfonyl), aliphatic or aromatic thio groups (for example, ethylthio and phenylthio), a hydroxyl group, a cyano group, —COOM or —$SO_3M$ (M:H, an alkali metal atom, e.g., Li, Na or K, or NH4), a nitro group, and halogen atoms (for example F, Cl, Br, I, preferably, F, Cl, Br).

Examples of the above-described substituted amino groups include a hydroxylamino, ethylamino, dimethylamino, butylamino and anilino groups.

ii) An unsubstituted ureido group and ureido groups substituted with at least one of (1, 2 or 3 hydrogen atoms of ureido group may be substituted) alkyl groups preferably having 1 to 30 carbon atoms and aryl groups preferably having 6 to 36 carbon atoms. These groups may be further substituted with at least one of the substituents which are disclosed above as "the substituents with which the group may be further substituted" in the definition of the amino group mentioned above.

An example of the substituted ureido group is a 3-ethylureido group.

iii) An unsubstituted imino group and imino groups substituted with alkylidene groups preferably having 1 to 30 carbon atoms, arylidene groups preferably having 6–30 carbon atoms or cycloalkylidene groups preferably having 1 to 30 carbon atoms, these groups may be further substituted with at least one of substituents which are disclosed above as "the substituents with which the group may be further substituted".

An example of the substituted imino group is a benzylidene amino group.

iv) Unsubstituted alkoxy groups or alkoxy groups substituted with at least one of the substituents disclosed above as "the substituents with which the group may be further substituted".

Examples of the alkoxy groups include a methoxy, propoxy, butoxy and amyloxy groups.

v) A hydroxyl group vi) An unsubstituted hydrazino group and hydrazino groups substituted (1, 2 or 3 hydrogen atoms of a hydrazino group may be substituted) with at least one of the alkyl groups having 1 to 30 carbon atoms and the aryl groups having 6 to 30 carbon atoms. These groups may be further substituted with at least one of the substituents disclosed above as "the substituents with which may be further substituted".

vii) A heterocyclic group preferably a 5- or 6-membered heterocyclic group containing at least one of N, O and S atoms as a hetero atom. The heterocyclic group may be condensed with a benzene ring, and may be substituted with at least one of the substituents disclosed above as "the substituents with which may be further substituted". (In the present invention a heterocyclic group has the same definition as stated herein unless it is otherwise defined.)

Examples of the heterocyclic group include a 3-pyridyl group, a 2-furyl group, a morpholino group, a piperidino group, and

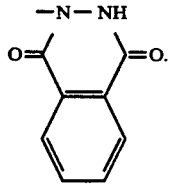

The substituent groups having a substituent constant ($\sigma p$) of −0.50 or less include substituted or unsubstituted amino groups (for example, amino, methylamino, ethylamino, dimethylamino and butylamino), substituted or unsubstituted imino groups (for example, benzylideneamino) and substituted or unsubstituted hydrazino groups.

In general formula (I), $R^2$ represents a hydrogen atom, an aliphatic group preferably having 1 to 36 carbon atoms, an aromatic group preferably having 6 to 36 carbon atoms (for example, phenyl or naphthyl) or a heterocyclic group (for example, 3-pyridyl, 2-furyl, 2-pyrrolyl or 2-thienyl, a morpholino group, a piperidino group and

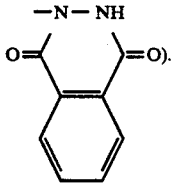

In addition, these groups may be substituted by substituents selected from alkyl groups, alkoxy groups (for example, methoxy and 2-methoxyethoxy), aryloxy groups (for example, 2,4-di-tert-amylphenoxy, 2-chlorophenoxy and 4-cyanophenoxy), alkenyloxy groups (for example, 2-propenyloxy), amino groups (for example, butylamino, dimethylamino, anilino and N-methylanilino), aliphatic or aromatic acyl groups (for example, acetyl and benzoyl), ester groups including those as defined hereinabove (for example, butoxycarbonyl, phenoxycarbonyl, acetoxy, benzoyloxy, butoxysulfonyl and toluenesulfonyloxy), amido groups (for example, acetylamino, methanesulfonamido), carbamoyl or thiocarbamoyl groups (for example, ethylcarbamoyl, dimethylcarbamoyl, butylsulfamoyl), thioureido groups (for example, dipropylsulfamoylamino), imido groups (for example, succinimido and hydantoinyl), ureido groups (for example, phenylureido and dimethylureido), aliphatic or aromatic sulfonyl groups (for example, methanesulfonyl and phenylsulfonyl), aliphatic or aromatic thio groups (for example, ethylthio and phenylthio), a hydroxyl group, a cyano group, —COOM or —$SO_3M$ (M:H, an alkali metal atom, e.g., Li, Na or K, or NH4), a nitro group, and halogen atoms (e.g., F, Cl, Br or I, preferably F, Cl or Br). These groups may be further substituted with at least one of these groups.

In this specification, the "aliphatic groups" mean straight, or branched or cyclic aliphatic hydrocarbon groups including saturated or unsaturated groups and further including saturated or unsaturated alicyclic hydrocarbon groups, such as alkyl, alkenyl, alkynyl and cycloalkyl groups. Typical examples thereof include methyl, ethyl, butyl, dodecyl, octadecyl, eicosenyl, iso-propyl, tert-butyl, tert-octyl, tert-dodecyl, cyclohexyl, cyclopentyl, allyl, vinyl, 2-hexadecenyl and propargyl groups; the "aromatic groups" means a substituted or unsubstituted phenyl or naphthyl group.

In general formula (I), $R^3$ represents, for example, a halogen atom, an unsubstituted or substituted (substituted with at least one substituent selected from those described above as "the substituents with which the group may be further substituted" the same hereinafter in the definition for $R^3$) aliphatic group preferably having 1 to 36 carbon atoms, an unsubstituted or substituted aromatic group preferably having 6 to 36 carbon atoms (for example, phenyl or naphthyl), an unsubstituted or substituted heterocyclic group (for example, 3-pyridyl, 2-furyl, a morpholino group, a pyperidino group, and

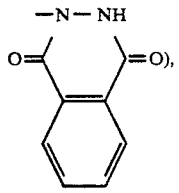

an unsubstituted or substituted alkoxy group (for example, methoxy or 2-methoxyethoxy), an unsubstituted or substituted aryloxy group (for example, 2,4-di-tert-amylphenoxy, 2-chlorophenoxy or 4-cyanophenoxy), an unsubstituted or substituted alkenyloxy group (for example, 2-propenyloxy), an unsubstituted or substituted amino group (for example, butylamino, dimethylamino, anilino or N-methylanilino), an unsubstituted or substituted aliphatic or aromatic acyl group (for example, acetyl or benzoyl), an ester group including those as defined hereinabove (for example, butoxycarbonyl, phenoxycarbonyl, acetoxy, benzoyloxy, butoxysulfonyl or toluenesulfonyloxy), an unsubstituted or substituted amido group (for example, acetylamino, or methanesulfonamido), an unsubstituted or substituted carbamoyl or thiocarbamoyl group (for example, ethylcarbamoyl, dimethylcarbamoyl, or butylsulfamoyl), an unsubstituted or substituted thioureido group (for example, dipropylsulfamoylamino), an unsubstituted or substituted imido group (for example, succinimido or hydantoinyl), an unsubstituted or substituted ureido group (for example, phenylureido or dimethylureido), an unsubstituted or substituted aliphatic or aromatic sulfonyl group (for example, methanesulfonyl or phenylsulfonyl), an unsubstituted or substituted aliphatic or aromatic oxycarbonyloxy group, an unsubstituted or substituted aromatic group, an unsubstituted or substituted aliphatic or aromatic or heterocyclic thio group (for example, ethylthio or phenylthio), a hydroxyl group, a cyano group, —COOM or —$SO_3M$ (M:H, an alkali metal atom, e.g., Li, Na, or K, or $NH_4$) or a nitro group.

$R^3$ is preferably a hydrogen atom or an eliminable group when $R^3$ is substituted at the position marked with * in general formula (I).

The cyan coupler of the present invention includes a bis type coupler which is bound through a carbon atom(s), obtained by condensation of 4-equivalent coupler at the eliminable group.

The eliminable group may contain a photographically useful group such as a development inhibitor or a development accelerator.

The couplers represented by general formula (I) are further preferably represented by general formula (II):

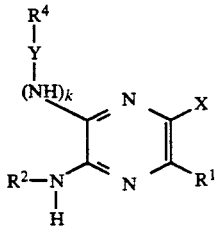

(II)

wherein $R^1$ and $R^2$ have the same meaning as given in general formula (I); k represents 0 or 1; Y represents —CO—or —$SO_2$—; $R^4$ represents a hydrogen atom, an unsubstituted or substituted aliphatic group, an unsubstituted or substituted aromatic group, an unsubstituted or substituted heterocyclic group, an amino group, an unsubstituted or substituted aliphatic amino group, an unsubstituted or substituted aromatic amino group, an unsubstituted or substituted aliphatic oxy group or an unsubstituted or substituted aromatic oxy group; and X represents a hydrogen atom or a group which is eliminable by coupling reaction with an oxidation product of a developing agent. Examples for substituents of the substituted groups are the same as those disclosed above as "the substituents with which the group may be further substituted".

In general formula (II), $R^4$ represents a hydrogen atom, an aliphatic group preferably having 1 to 36 carbon atoms (for example, methyl, ethyl or phenetyl), an aromatic group preferably having 6 to 36 carbon atoms (for example, phenyl or naphthyl), a heterocyclic group (for example, 3-pyridyl or 2-furyl), an amino group, an aliphatic amino group (for example, butylamino or octylamino), an aromatic amino group (for example, anilino or p-methoxyanilino), an aliphatic oxy group (for example, methoxy, ethoxy or i-butoxy) or an aromatic oxy group (for example, phenoxy). As described above these groups may be substituted.

X represents a hydrogen atom or a group which is eliminable by coupling reaction (hereinafter referred to as an eliminable group).

Specific examples of the eliminable groups include halogen atoms (for example, fluorine, chlorine and bromine), alkoxy groups (for example, ethoxy, dodecyloxy, methoxyethylcarbamoylmethoxy, carboxypropyloxy and methylsulfonylethoxy), aryloxy groups (for example, 4-chlorophenoxy, 4-methoxyphenoxy and 4-carboxyphenoxy), acyloxy groups (for example, acetoxy tetradecanoyloxy, and benzoyloxy), aliphatic or aromatic sulfonyloxy groups (for example, methanesulfonyloxy and toluenesulfonyloxy), acylamino groups (for example, dichloroacetylamino and heptafluorobutylylamino), aliphatic or aromatic sulfonamido groups (for example, methanesulfonamido and p-toluenesulfonamido), alkoxycarbonyloxy groups (for example, ethoxycarbonyloxy and benzyloxycarbonyloxy), aryloxycarbonyloxy groups (for example, phenoxycarbonyloxy), aliphatic, aromatic or heterocyclic thio groups (for example, ethylthio, phenylthio and tetrazolylthio), ureido groups (for example, N-methylcarbamoylamino and N-phenylcarbamoylamino), 5- or 6-membered nitrogen-containing heterocyclic groups (for example, imidazolyl, pyrazolyl, triazolyl, tetrazolyl and 1,2-dihydro-2-oxo-1-pyridyl), imido groups (for example, succinimido and hydantoinyl) and aromatic azo groups (for example, phenylazo). In addition, these groups may be substituted by the groups permissible as the substituent groups of $R^3$ As the eliminable group bound through a carbon atom, there is a bis-type coupler obtained by condensing a 4-equivalent coupler with an aldehyde or a ketone. (A typical example of such a coupler is "Coupler (32) disclosed in page 357 in T. H.James, *The Theory of the Photographic Process*, 4th ed.) The eliminable groups used in the present invention may contain photographically useful groups such as development inhibitors and development accelerators.

In general formula (II), X is more preferably a hydrogen atom, a halogen atom, an aliphatic or aromatic oxy group, an aliphatic or aromatic thio group, an aliphatic or aromatic oxycarbonyloxy group, an aliphatic or aromatic carbonyloxy group or an aliphatic or aromatic sulfonyloxy group.

The wavelength of the maximum absorption of the dye obtained by coupling reaction of the cyan coupler of the present invention and an oxidized product of an aromatic primary amine developing agent is generally from about 580 to 700 nm.

Specific examples of the couplers of the present invention are hereinafter illustrated. However, the scope of the present invention is not limited thereto.

(1)

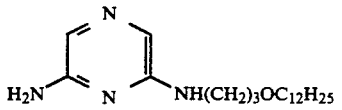

(2)

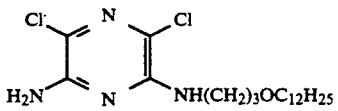

(3)

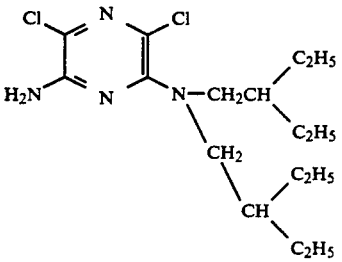

(4)

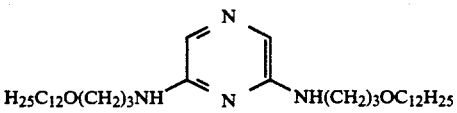

(5)

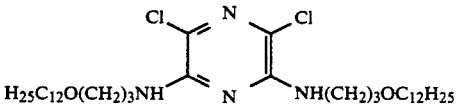

(6)

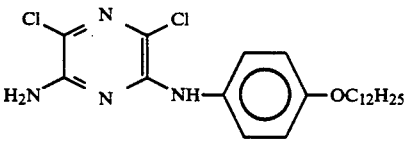

(7)

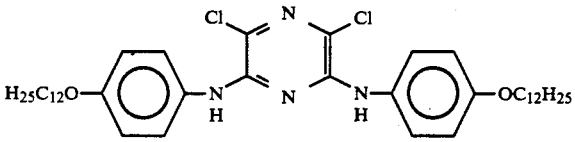

(8)

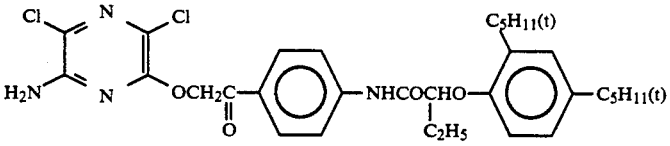

(9)

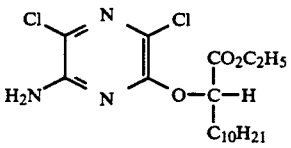

(10)

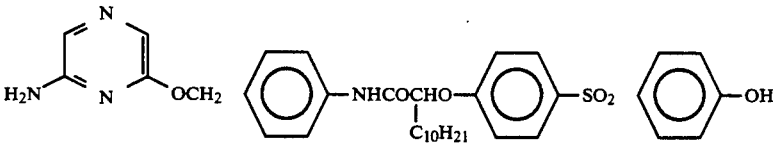

(11)

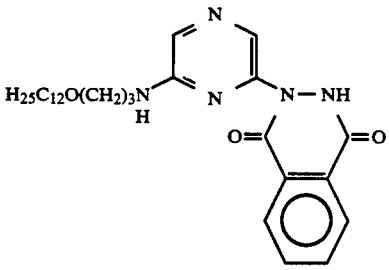

(12)

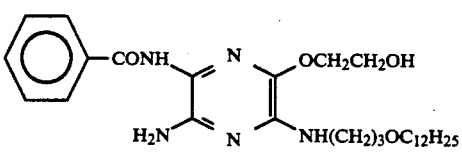

(13)

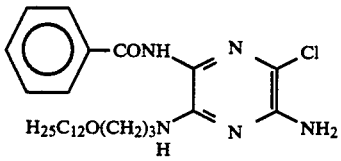

(14)

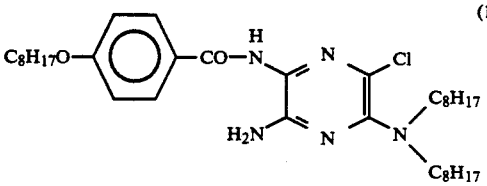

-continued (15)

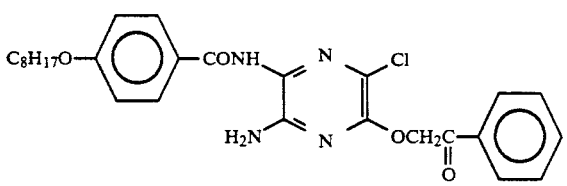

(16)

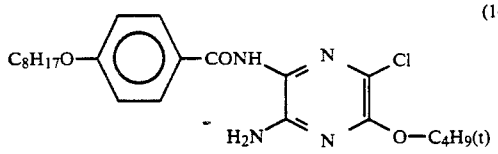

(17)

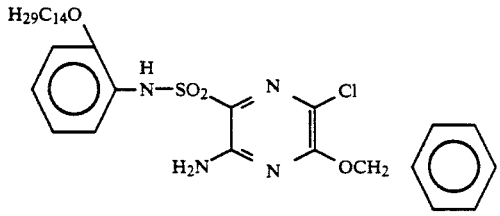

(18)

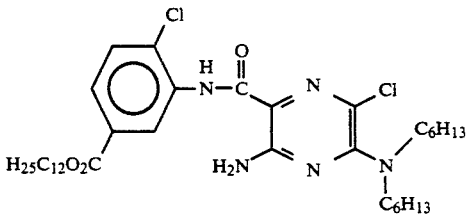

(19)

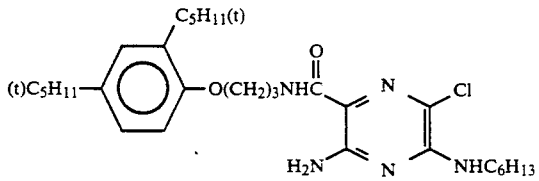

(20)

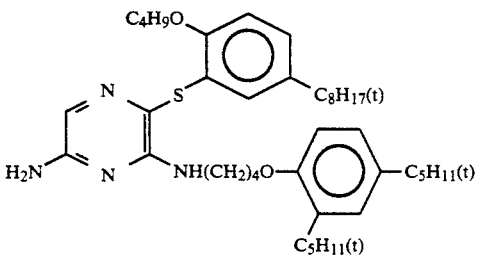

(21)

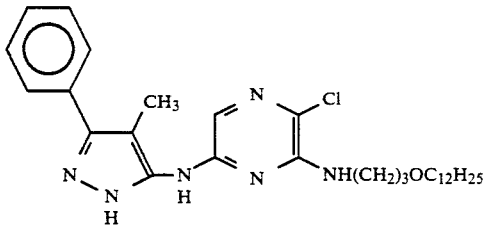

(22)

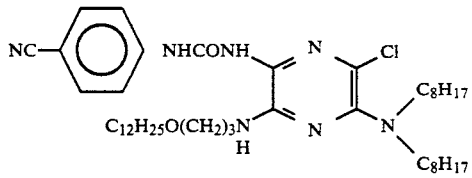

(23)

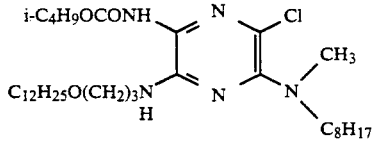

(24)

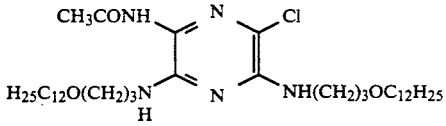

Synthesis examples of the typical couplers of the present invention are hereinafter described.

Synthesis Example 1-Synthesis of Coupler (1)

Coupler (1) was synthesized according to the following synthesis route:

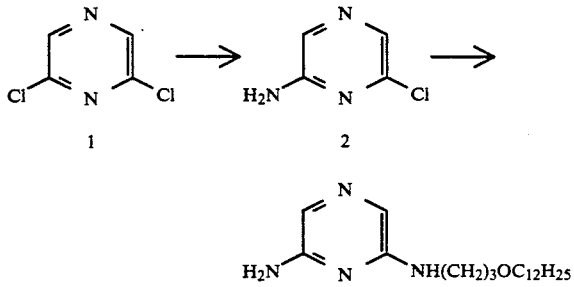

Coupler (1)

Synthesis of 2-amino-6-chloropyrazine (2)

25 g of 2,6-dichloropyrazine (1) and 35 ml of 29% aqueous ammonia were stirred in an autoclave at 100° C. for 5 hours. Then, the contents were slowly allowed to cool to room temperature while stirring. The precipitated crystals were filtered and washed with water, followed by air-drying, thereby obtaining 18.4 g of 2-amino-6-chloropyrazine (2) as pale brown crystals.

Synthesis of Coupler (1)

To 2.6 g of 2-amino-6-chloropyrazine (2), 10 ml of dodecyloxypropylamine was added, and the mixture was stirred on an oil bath at 140° to 150° C. for 8 hours. Then, the resulting product was cooled to room temperature, and purified by silica gel chromatography, thereby obtaining 3.0 g of coupler (1) as an oily product.

Synthesis Example 2-Synthesis of Coupler (4)

Coupler (4) was synthesized according the following synthesis route:

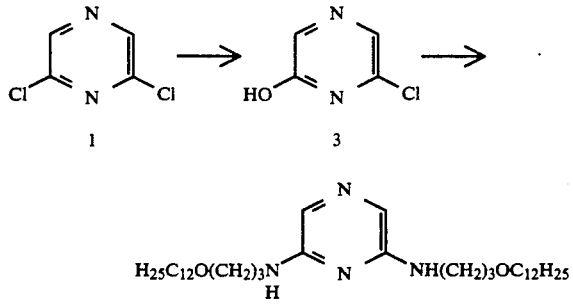

Coupler (4)

Synthesis of 2-chloro-6-hydroxypyrazine (3)

To 7.4 g of 2,6-dichloropyrazine (1), 25 ml of tetrahydrofuran was added, and a solution prepared by dissolving 4.5 g of sodium hydroxide in 125 ml of water was further added thereto, followed by heating under heat reflux for 5 hours. The resulting product was cooled to room temperature, and 6 ml of concentrated hydrochloric acid was added dropwise thereto. The precipitated white crystals were filtered to obtain 6.1 g of 2-chloro-6-hydroxypyrazine (3).

Synthesis of coupler (4)

To 5.2 g of 2-chloro-6-hydroxypyrazine (3), 40 ml of dodecyloxypropylamine was added, and the mixture was stirred on an oil bath at 160° to 170° C. for 1 hours. Then, the resulting oily product was purified by silica gel chromatography (solvent: methylene chloride/ethyl acetate=2/1 by volume), thereby obtaining 4.2 g of coupler (4) as an oily product.

Synthesis Example 3-Synthesis of Coupler (24):

To 2.8 g of coupler (4), 10 ml of methanol was added, and a solution prepared by dissolving 2.8 g of sodium hydroxide in 10 ml of water was further added thereto. Furthermore, an aqueous solution of the diazonium salt prepared from 1.0 g of sulfanilic acid and 0.43 g of sodium nitrite separately was added thereto keeping the reaction temperature at 5° to 10° C. under ice cooling. After the reaction was conducted for 1 hour, 30 ml of water was added thereto. An aqueous solution containing 10 g of sodium hydrosulfite was further added thereto little by little, followed by stirring at an internal temperature of 60° C. for 30 minutes. The resulting product was cooled to room temperature, and ethyl acetate was added thereto for liquid separation. After washing with water, the organic layer was dried with Glauber's salt, and the solvent was removed by distillation. To the resulting oily product, 30 ml of acetonitrile was added, and 0.5 ml of acetic anhydride was further added, followed by heating under heat-reflux for 1 hour. The resulting product was cooled to room temperature, and ethyl acetate was added thereto. After liquid separation and washing with water, the solvent was removed by distillation. The resulting oily product was purified by silica gel chromatography (solvent: methylene chloride/methanol=10/1 by volume), thereby obtaining 0.70 g of coupler (24) as an oily product.

Other pyrazine compounds of the present invention can be obtained according to the methods disclosed in B. G. Barlin, John Wiley & Sons, The *Chemistry of Heterocyclic Compound*, Vol. 41, "The Pyrazines", Chapter III (1982).

The couplers of the present invention are added to light-sensitive materials.

When the light-sensitive materials are produced by using the couplers of the present invention, the couplers may be used in any of the light-sensitive layers (for example, red-sensitive emulsion layers, green-sensitive emulsion layers and blue-sensitive emulsion layers) and in any of the nonsensitive layers (for example, protective layers, intermediate layers and antihalation layers). In particular, it is preferred that they are added to the red-sensitive layers.

When the couplers of the present invention are added to the light-sensitive materials, they are usually applied in an amount of 0.01 to 5 mmol, preferably 0.1 to 2 mmol per square meter of the layer containing the couplers. When the cyan couplers of the present invention are added to the light-sensitive layers, they are usually used in an amount of 0.002 to 2 mol, preferably 0.01 to 1 mol per light-sensitive silver halide contained in the same layer.

The cyan couplers of the present invention may be used alone, or two or more kinds of them may be used in combination with a cyan coupler other than that of the present invention with one another. When they are used in combination, it is preferred that the couplers of the present invention are contained in an amount of 50 mol % or more of total cyan couplers.

The color photographic material of the present invention can be formed by applying at least one layer for each of the blue-sensitive, green-sensitive and red-sensitive silver halide emulsion layers on a support in this order, but they may be applied in a different order. Further, an infrared-sensitive silver halide emulsion layer can be used in place of at least one of the above-described light-sensitive emulsion layers. Each of these light-sensitive emulsion layers contains a silver halide emulsion having sensitivity to each wavelength region and a dye complementary to the light to which the emulsion layer is sensitive, and thereby color reproduction can be achieved according to a subtractive color process. However, the light-sensitive emulsion layers and the formed colors may be combined so as not to have the correspondence described above.

The couplers of the present invention can be incorporated in the photographic materials by various conventional dispersion methods.

Examples of the high boiling solvents used in the oil-in-water dispersion methods are described in U.S. Pat. No. 2,322,027. Further, the stages and effects of dispersion methods using latexes, which belong to polymer dispersion methods, and specific examples of the latexes for impregnation are described in U.S. Pat. No. 4,199,363, West German Patents (OLS) 2,541,274 and 2,541,230, JP-B-53-41091 (the term "JP-B" as used herein means an "examined Japanese patent publication") and European Patent 029104. Dispersion methods using organic solvent-soluble polymers are described in PCT International Publication No. W088/00723.

The high boiling organic solvents which can be used in the above-described oil-in-water dispersion methods include phthalates [for example, dibutyl phthalate, dioctyl phthalate, dicyclohexyl phthalate, di-2-ethylhexyl phthalate, decyl phthalate, bis(2,4-di-t-amylphenyl) isophthalate and bis(1,1-diethylpropyl) phthalate], phosphates or phosphonates (for example, diphenyl phosphate, triphenyl phosphate, tricresyl phosphate, 2-ethylhexyldiphenyl phosphate, dioctylbutyl phosphate, tricyclohexyl phosphate, tri-2-ethylhexyl phosphate, tridodecyl phosphate and di-2-ethylhexylphenyl phosphonate), benzoates (for example, 2-ethylhexyl benzoate, 2,4-dichlorobenzoate, dodecyl benzoate and 2-ethylhexyl-p-hydroxy benzoate), amides (for example, N,N-diethyldodecaneamide and N,N-diethyllaurylamide), alcohols (for example, isostearyl alcohol), aliphatic esters (for example, dibutoxyethyl succinate, di-2-ethylhexyl succinate, 2-hexyldecyl tetradecanoate, tributyl citrate, diethyl azelate, isostearyl lactate and trioctyl citrate), aniline derivatives (for example, N,N-dibutyl-2-butoxy-5-tert -octylaniline), chlorinated paraffins (for example, paraffins having a chlorine content of 10 to 80% by weight), trimesates [for example, tributyl trimesate), dodecylbenzene, diisopropylnaphthalene, phenols (for example, 2,4-di-tert-amylphenol, 4-dodecyloxyphenol, 4-dodecyloxycarbonylphenol and 4-(4-dodecyloxyphenylsulfonyl)phenol], carboxylic acids [for example, 2-(2,4-di-tert-amylphenoxy)butyric acid and 2-ethoxyoctanedecanoic acid] and alkylphosphoric acids [for example, di-(2-ethylhexyl)phosphoric acid and diphenylphosphonic acid]. Organic solvents having a boiling point of about 30 to about 160° C. may also be used in combination therewith as supplementary solvents. Examples of such organic solvents include ethyl acetate, butyl acetate, ethyl propionate, methyl ethyl ketone, cyclohexanone, 2-ethoxyethyl acetate and dimethylformamide.

Of the above-described solvents, the high boiling organic solvents such as phthalates, aliphatic esters, chlorinated paraffins, phenols, carboxylic acids and alkylphosphoric acids are preferably used for the couplers of the present invention. In particular, the high boiling organic solvents preferably have a dielectric constant of about 6.5 or less, more preferably 5 to 6.5 (measured at 25° C. at 10 Hz). In order to obtain a maximum cyan density without increasing a maximum yellow density, it is preferable to use an acidic oil such as a high boiling organic solvent having a phenolic hydroxy group or a carboxyl group.

It is preferred that the couplers of the present invention dissolved in the high boiling organic solvents (which may be used in combination with the low boiling organic solvents) are emulsified in aqueous solutions of gelatin and then added to silver halide emulsions. The high boiling point organic solvents can be used in a 0 to 2.0-fold amount, preferably in a 0 to 1.0-fold amount by weight ratio to coupler.

The couplers of the present invention can be applied, for example, to color paper, color reversal paper, direct positive photographic materials, color negative film, color positive film, color reversal film and the like. Among them, the couplers are preferably applied to color photographic materials having reflecting supports (such as color paper and color reverse paper) and color photographic materials for forming positive images (such as direct positive color photographic materials, color positive film and color reverse film). In particular, the application to the color photographic materials having the reflecting supports is preferred.

Silver halides having any halogen composition such as silver iodobromide, silver iodochlorobromide, silver bromide, silver chlorobromide and silver chloride may be used for the silver halide emulsions used in the present invention.

Grains contained in the emulsion may be the same or different from one another in halogen composition. However, when the emulsion containing the grains each of which has the same halogen composition is used, it is easy to homogenize the properties of each grain. With respect to the internal halogen composition distribution of the silver halide grains, there can be suitably selected to use the grains of a so-called uniform type structure in which the composition is the same at any portion of the grain, grains of a so-called laminated type structure in which an internal core of the grain is different from a shell (one layer or a plurality of layers) surrounding it in halogen composition, or the grains of a structure in which the inside of the grain or the surface thereof has non-layer portions different in halogen composition (a structure in which the portions different in halogen composition are connected to the edges, the corners or the plane of the grain when they are on the surface of the grain). In order to obtain high sensitivity, it is more advantageous to use either of the latter two grains than to use the grains of the uniform type structure. The latter two grains are preferable also with respect to restraint of generation of stress marks. When the silver halide grains have the structure as described above, a boundary between portions different from each other in halogen composition may be clear or unclear due to formation of mixed crystals by the difference in composition. Further, continuous changes in structure may be positively given thereto.

The preferred halogen composition varies depending on the type of photographic material to which the silver halide emulsion is applied. The silver chlorobromide emulsions are mainly used for color paper. The silver iodobromide emulsions are used for photographic materials for picture taking such as color negative film, and the silver bromide or silver chlorobromide emulsions are used for direct positive color photographic materials. Further, so-called high silver chloride emulsions having a high silver chloride content are preferably used for photographic materials for color paper suitable for rapid processing. The silver chloride content of these high silver chloride emulsions is preferably at least 90 mol %, and more preferably at least 95 mol %.

In such high silver chloride emulsions, the grains of a structure in which the inside and/or the surface of the silver halide grain has silver bromide-localized phases in a layer form or in a non-layer form are preferred. The halogen composition of the abovedescribed localized phases is preferably at least 10 mol %, and more preferably above 20 mol % in silver bromide content. These localized phases can exist inside the grain and on the edges, the corners and the planes of the surface of the grain. As one preferred example, there can be mentioned localized phases formed on the corner portions of the grain by epitaxial growth.

In the present invention, it is particularly preferred that emulsions comprising silver chlorobromide or silver chloride substantially free from silver iodide are used. Here, "substantially free from silver iodide" means that the content of silver iodide is 1 mol % or less, and preferably 0.2 mol % or less.

It is preferred that the silver halide grains contained in the silver halide emulsions used in the present invention have a mean grain size of 0.1 to 2 μm, and preferably 0.15 to 1.5 μm. The mean grain size is a number mean value of grain sizes represented by the diameters of circles equivalent to the projected areas of grains. Further, it is preferred that these emulsions are so-called monodisperse emulsions having a grain size distribution, namely a coefficient of variation (the standard deviation of the grain size distribution divided by the mean grain size) of not more than 20%, and desirably not more than 15%. At this time, for the purpose of obtaining a wide latitude, it is preferred that the above-described monodisperse emulsions can be blended in the same layer or can be coated in multiple layers.

The silver halide grains contained in the emulsions may have a regular crystal form such as a cubic, an octahedral or a tetradecahedral, or an irregular crystal form such as a spherical form or a plate form, or a composite form thereof. Further, flat plate-form grains may be used.

The silver halide emulsions used in the present invention may be a so-called surface latent image type emulsion in which a latent image is mainly formed on the surfaces of the grains, or a so-called internal latent image type emulsion in which a latent image is mainly formed in the interior of the grains.

The silver halide emulsions which can be used in the present invention can be prepared, for example, according to the methods described in *Research Disclosure* (RD), No. 17643, pages 22 and 23, "I. Emulsion Preparation and Types" (Dec., 1978), ibid., No. 18716, page 648 (Nov., 1979), P. Glafkides, *Chimie et Phisique Photographique* (Paul Montel, 1967), G. F. Duffin, *Photographic Emulsion Chemistry* (Focal Press, 1966) and V. L. Zelikman et al., *Making and Coating Photographic Emulsion* (Focal Press, 1964).

The monodisperse emulsions described in U.S. Pat. Nos. 3,574,628 and 3,655,394 and British Patent 1,413,748 are also preferably used.

Further, flat plate-form grains having an aspect ratio of 5 or more can also be used in the present invention. The flat plate-form grains can be easily prepared by the methods described in Gutoff, *Photographic Science and Engineering*, Vol. 14, pages 248 to 257 (1970), U.S. Pat. Nos. 4,434,226, 4,414,310, 4,433,048 and 4,439,520 and British Patent 2,112,157.

The crystal structure may be uniform, or the interior of the grain may be different from the surface thereof in halogen composition. The crystal structure may also be a laminar structure. Silver halide grains having different compositions may be joined together by epitaxial bonding. Further, silver halide grains may be joined to compounds other than silver halides such as silver rhodanide and lead oxide.

Furthermore, mixtures of grains having various crystal forms may also be used.

The silver halide emulsions used in the present invention are generally subjected to physical ripening, chemical ripening and spectral sensitization.

In the course of formation of grain emulsions or physical ripening, various multivalent metal ion impurities can be introduced in the silver halide emulsions used in the present invention. Examples of compounds used include salts of cadmium, zinc, lead, copper and thallium, salts of the Group VIII metals of the Periodic Table, such as iron, ruthenium, rhodium, palladium, osmium, iridium and platinum, and complex salts thereof.

Additives used in physical ripening, chemical ripening and spectral sensitization stages of the silver halide emulsions used in the present invention are described in *Research Disclosure*, No. 17643, ibid., No. 18716 and ibid., No. 307105, and are summarized in the following table. Other conventional photographic additives which can be used in the present invention are also described in the above three *Research Disclosure* references, and are shown in the following table.

| Type of Additives | RD 17643 | RD 18716 | RD 307105 |
|---|---|---|---|
| 1. Chemical Sensitizers | p. 23 | p. 648, right column | p. 866 |
| 2. Sensitivity Increasing Agents | — | p. 648, right column | — |
| 3 Spectral Sensitizers, Supersensitizers | pp. 23–24 | p. 648, right column to p. 649, right column | pp. 866–868 |
| 4. Brightening Agents | p. 24 | p. 647 right column | p. 868 |
| 5. Antifoggants and Stabilizers | pp. 24–25 | p. 649, right column | pp. 868–870 |
| 6. Light Absorbers, Filter Dyes, UV Absorbers | pp. 25–26 | p. 649, right column to p. 650, left column | p. 873 |
| 7. Stain Inhibitors | p. 25, right column | p. 650, left to right columns | p. 872 |
| 8. Dye Image Stabilizers | p. 25 | p. 650, left column | p. 872 |
| 9. Hardeners | p. 26 | p. 651, left column | pp. 874–875 |
| 10. Binders | p. 26 | p. 651, left column | pp. 873–874 |
| 11. Plasticizers, Lubricants | p. 27 | p. 650, right column | p. 876 |
| 12. Coating Aids, Surfactants | pp. 26–27 | p. 650, right column | pp. 875–876 |
| 13. Antistatic Agents | p. 27 | p. 650, right column | pp. 876–877 |
| 14. Matting Agents | — | — | pp. 878–879 |

In order to prevent deterioration in photographic properties due to formaldehyde gas, the compounds which can react with formaldehyde to fix it, described in U.S. Pat. Nos. 4,411,987 and 4,435,503, can also be added to the photographic materials.

Various color couplers may be used in combination with the couplers of the present invention. Specific examples thereof are described in the patents cited in *Research Disclosure* (RD), No. 17643, VII-C to G and ibid. No. 307105, VII-C to G described above.

Preferred examples of yellow couplers are described in U.S. Pat. Nos. 3,933,501, 4,022,620, 4,326,024, 4,401,752 and 4,248,961, JP-B-58-10739, British Patents 1,425,020 and 1,476,760, U.S. Pat. Nos. 3,973,968, 4,314,023 and 4,511,649 and European Patent 249,473A.

It is preferred from the viewpoint of color reproduction that the couplers of the present invention are used in combination with yellow couplers in which the maximum absorption wavelength of forming dyes formed is positioned on a short wavelength side and absorption in a long wavelength region exceeding 500 nm decreases sharply. Examples of such yellow couplers are described in JP-A-63-123047 and JP-A-1-173499.

As magenta couplers, 5-pyrazolone compounds or pyrazoloazole compounds are preferably used. Particularly preferred examples thereof are described in U.S. Pat. Nos. 4,310,619 and 4,351,897, European Patent 73,636, U.S. Pat. Nos. 3,061,432 and 3,725,067, *Research Disclosure*, No. 24220 (Jun., 1984), JP-A-60-33552, *Research Disclosure*, No. 24230 (Jun., 1984), JP-A-60-43659, JP-A-61-72238, JP-A-60-35730, JP-A-55-118034, JP-A-60-185951, U.S. Pat. Nos. 4,500,630, 4,540,654 and 4,556,630 and PCT International Publication No. W088/04795.

The pyrazoloazole compounds are preferred to the pyrazolone compounds in terms of the absorption characteristics of forming dyes. Particularly among them, imidazo[1,2-b]pyrazoles described in U.S. Pat. No. 4,500,630, pyrazolo[1,5-b][1,2,4]triazoles described in U.S. Pat. No. 4,540,654 and pyrazolo[5,1-c][1,2,4]triazole described in U.S. Pat. No. 3,725,067 are preferable. Of these compounds, the pyrazolo[1,5-b][1,2,4]triazoles are particularly preferable in terms of lightfastness.

Cyan couplers include phenol couplers and naphthol couplers. Preferred examples thereof are described in U.S. Pat. Nos. 4,052,212, 4,146,396, 4,228,233, 4,296,200, 2,369,929, 2,801,171, 2,772,162, 2,895,826, 3,772,002, 3,758,308, 4,334,011 and 4,327,173, West German Patent (OLS) 3,329,729, European Patents 121,365A and 249,453A, U.S. Pat. Nos. 3,446,622, 4,333,999, 4,775,616, 4,451,559, 4,427,767, 4,690,889, 4,254,212 and 4,296,199 and JP-A-61-42658.

Colored couplers for correcting unnecessary absorption of forming dyes may also be used. Preferred examples of such couplers are described in *Research Disclosure*, No. 17643, Item VII-G, U.S. Pat. No. 4,163,670, JP-B-57-39413, U.S. Pat. Nos. 4,004,929 and 4,138,258 and British Patent 1,146,368. It is also preferred to use couplers for correcting unnecessary absorption of forming dyes with fluorescent dyes released on coupling and to use couplers having dye precursor groups as eliminable groups which can form dyes by reacting with developing agents. The former couplers are described in U.S. Pat. No. 4,774,181 and the latter couplers are described in U.S. Pat. No. 4,777,120.

As couplers whose forming dyes have appropriate diffusibility, those described in U.S. Pat. No. 4,366,237, British Patent 2,125,570, European Patent 96,570 and West German Patent (OLS) 3,234,533 are preferable.

Typical examples of polymerized dye-forming couplers are described in U.S. Pat. Nos. 3,451,820, 4,080,211, 4,367,282, 4,409,320 and 4,576,910 and British Patent 2,102,173.

Couplers which release photographically useful residues on coupling can also be used in the present invention. Preferred DIR couplers which release development inhibitors are described in the patents cited in *Research Disclosure*, No. 17643, Item VII-F described above, JP-A-57-151944, JP-A-57-154234, JP-A-60-184248, JP-A-63-37346 and U.S. Pat. Nos. 4,248,962 and 4,782,012.

Preferred couplers which release nucleating agents or development accelerators in image-like forms are described in British Patents 2,097,140 and 2,131,188, JP-A-59-157638 and JP-A-59-170840.

Other couplers which can be used in combination with the couplers of the present invention include competitive couplers described in U.S. Pat. No. 4,130,427, multiequivalent couplers described in U.S. Pat. Nos. 4,283,472, 4,338,393 and 4,310,618, DIR redox compound releasing couplers, DIR coupler releasing couplers, DIR coupler releasing redox compounds and DIR redox compound releasing redox compounds described in JP-A-60-185950 and JP-A-62-24252, couplers which release dyes recoloring after elimination described in European Patent 173,302A, bleaching promoter releasing couplers described in *Research Disclosure*, No. 11449, *Research Disclosure*, No. 24241 and JP-A-61-201247, ligand releasing couplers described in U.S. Pat. No. 4,553,477, leuco dye releasing couplers described in JP-A-63-75747 and fluorescent dye releasing couplers described in U.S. Pat. No. 4,774,181.

The standard amount of the color couplers which can be used in combination with the couplers of the present invention ranges from 0.001 to 1 mol per mol of light-sensitive silver halide. The amount is preferably 0.01 to 0.5 mol for yellow couplers, 0.003 to 0.3 mol for magenta couplers, and 0.002 to 0.3 mol for cyan couplers, each per mol of light-sensitive silver halide.

The couplers which can be used in combination can be incorporated in the photographic materials by the various conventional dispersion methods described above.

The photographic materials of the present invention may contain color antifoggants such as hydroquinone derivatives, aminophenol derivatives, gallic acid derivatives and ascorbic acid derivatives.

The photographic materials of the present invention may also contain various antifading agents. Namely, typical examples of organic antifading agents for cyan, magenta and/or yellow images include hindered phenols such as hydroquinones, 6-hydroxychromans, 5-hydroxycoumarans, spirochromans, p-alkoxyphenols and bisphenols, gallic acid derivatives, methylenedioxybenzenes, aminophenols, hindered amines, and ether or ester derivatives obtained by silylating or alkylating phenolic hydroxyl groups of these compounds. Further, metal complexes represented by (bissalicylaldoximato)-nickel complexes and (bis-N,N-dialkyldithiocarbamato)-nickel complexes can also be used.

Specific examples of the organic antifading agents include hydroquinones described in U.S. Pat. Nos. 2,360,290, 2,418,613, 2,700,453, 2,701,197, 2,728,659, 2,732,300, 2,735,765, 3,982,944, 4,430,425, 2,710,801 and 2,816,028 and British Patent 1,363,921; 6-hydroxychromans, 5-hydroxychromans and spirochromans described in U.S. Pat. Nos. 3,432,300, 3,573,050, 3,574,627, 3,698,909 and 3,764,337 and JP-A-52-152225; spiroindanes described in U.S. Pat. No. 4,360,589; p-alkoxyphenols 2,066,975, JP-A-59-10539 and JP-B-57-19765; hindered phenols described in U.S. Pat. Nos. 3,700,455 and 4,228,235, JP-A-52-72224 and JP-B-52-6623; gallic acid derivatives described in U.S. Pat. No. 3,457,079; methylenedioxybenzenes described in U.S. Pat. No. 4,332,886; aminophenols described in JP-B-56-21144; hindered amines described in U.S. Pat. Nos. 3,336,135 and 4,268,593, British Patents 1,326,889, 1,354,313 and 1,410,846, JP-B-51-1420, JP-A-58-114036, JP-A-59-53846 and JP-A-59-78344; and metal complexes described in U.S. Pat. Nos. 4,050,938 and 4,241,155 and British Patent 2,027,731(A). Each of these compounds is usually emulsified together with each corresponding color coupler in an amount of 5 to 100% by weight based on the weight of the coupler and the resulting emulsion is added to the light-sensitive emulsion layer, whereby the object can be attained. In order to prevent cyan dye images from deterioration due to heat and particularly light, it is more effective to introduce an ultraviolet absorber in a cyan color forming layer and layers on both sides adjacent thereto.

Ultraviolet absorbers which can be used include benzotriazole compounds substituted by aryl groups (for example, the compounds described in U.S. Pat. No. 3,533,794), 4-thiazolidone compounds (for example, the compounds described in U.S. Pat. Nos. 3,314,794 and 3,352,681), benzophenone compounds (for example, the compounds described in JP-A-46-2784), cinnamate compounds (for example, the compounds described in U.S. Pat. Nos. 3,705,805 and 3,707,395), butadiene compounds (for example, the compounds described in U.S. Pat. No. 4,045,229) and benzoxazole compounds (for example, the compounds described in U.S. Pat. Nos. 3,406,070 and 4,271,307). Ultraviolet-absorptive couplers (for example, α-naphthol cyan dye-forming couplers) and ultraviolet-absorptive polymers may also be used. These ultraviolet absorbers may also be mordanted to a specific layer.

In particular, above-described benzotriazole compounds substituted by aryl groups are preferably used.

Gelatin can be advantageously used as a binder or a protective colloid for emulsion layers of the photographic materials of the present invention. However, hydrophilic colloids other than gelatin may be used alone or in combination with gelatin.

Gelatin used in the present invention may be either treated with lime or treated with an acid. The details of the methods for preparing gelatin are described in Arthur Vice, *The Macromolecular Chemistry of Gelatin* (Academic Press, 1964).

It is preferred to add various preservatives and antifungal agents to the photographic materials of the present invention. Examples of such preservatives and antifungal agents include 1,2-benzisothiazoline-3-one, n-butyl-p-hydroxybenzoate, phenol, 4-chloro-3,5-dimethylphenol, 2-phenoxyethanol and 2-(4-thiazolyl)benzimidazole described in JP-A-63-257747, JP-A-62-272248 and JP-A-1-80941.

When the photographic materials of the present invention are the direct positive color photographic materials, nucleating agents such as hydrazine compounds and quaternary heterocyclic compounds described in *Research Disclosure*, No. 22534 (Jan., 1983) and nucleating accelerators for enhancing the function of the nucleating agents may be used.

In the present invention, a transparent film such as a cellulose nitrate film or a polyethylene terephthalate film, or a reflecting support, which is usually used for photographic materials, can be used as the support. For the purpose of the present invention, it is more preferable to use the reflecting support.

The "reflecting.support" preferably used in the present invention means a support whose reflectivity is increased to clarify dye images formed on halogen halide emulsion layers. Such supports include supports coated with hydrophobic resins containing light reflective materials such as titanium dioxide, zinc oxide, calcium carbonate and calcium sulfate dispersed therein, and supports formed of hydrophobic resins containing light reflective materials dispersed therein. Examples thereof include baryta paper, polyethylene-coated paper, synthetic polypropylene paper and transparent supports provided with reflective layers or used in combination with reflective materials (for example, glass plates, cellulose films such as cellulose triacetate films and cellulose nitrate films, polyester films such as polyethylene terephthalate films, polyamide films, polycarbonate films, polystyrene films and vinyl chloride resins).

The photographic materials according to the present invention can be developed by conventional methods described in *Research Disclosure*, No. 17643, pages 28 and 29 and ibid., No. 18716, page 615, left column to right column described above. For example, color development, desilverization and washing with water are carried out. In the desilverization stage, the bleach-fixing treatment may also be conducted using a bleach-fixing solution in place of bleaching using a bleaching solution and fixing using a fixing solution. Bleaching, fixing and bleach-fixing may be combined with one another in any order. Stabilization may be carried out instead of or after washing with water. Further, monobath processing using a monobath developing-bleaching-fixing solution for performing color development, bleaching and fixing in one bath can be carried out. Pre-hardening, neutralization thereof, stop fixing, post-hardening, compensation and intensification may be combined with these processing stages. An intermediate stage of washing with water may be arbitrarily provided between the above-described stages. In these processes, so-called activator processing may be carried out in place of the color development.

The color developing solutions used for development of the photographic materials of the present invention are preferably aqueous alkaline solutions mainly containing aromatic primary amine color developing agents. Although aminophenol compounds are useful as the color developing agents, p-phenylenediamine compounds are preferably used. Typical examples thereof include 3methyl-4-amino-N,N-diethylaniline, 3-methyl-4-amino-N-ethyl-N-β-hydroxyethylaniline, 3-methyl-4-amino-N-ethyl-N-β-methanesulfonamidoethylaniline, and sulfates, hydrochlorides and p-toluenesulfonates thereof. Of these compounds, 3-methyl-4-amino -N-ethyl-N-β-hydroxyethylaniline sulfate is particularly preferable. Two or more kinds of these compounds can also be used in combination with one another depending on the intended purpose.

The color developing solutions generally contain pH buffers such as alkali metal carbonates, borates and phosphates, and development inhibitors or antifoggants such as chlorides, bromides, iodides, benzimidazoles, benzothiazoles and mercapto compounds. Further, the color developing solutions may contain various preservatives including hydrazines such as hydroxylamine, diethylhydroxylamine, sulfites and N,N-biscarboxymethylhydrazine, phenylsemicarbazides, triethanolamine and catechol sulfonic acids; organic solvents such as ethylene glycol and diethylene glycol; development accelerators such as benzyl alcohol, polyethylene glycol, quaternary ammonium salts and amines; dye-forming couplers; competitive couplers; auxiliary developing agents such as 1-phenyl-3-pyrazolidone; nucleating agents such as sodium boron hydride and hydrazine compounds; viscosity-imparting agents (tackifiers); various chelating agents represented by aminopolycarboxylic acids, aminopolyphosphonic acids, alkylphosphonic acids and phosphonocarboxylic acids [for example, ethylenediaminetetraacetic acid, nitrilotriacetic acid, diethylenetriaminepentaacetic acid, cyclohexanediaminetetraacetic acid, hydroxyethyliminodiacetic acid, 1-hydroxyethylidene-1,1-diphosphonic acid, nitrilo-N,N,N-trimethylenephosphonic acid, ethylenediamine -N,N,N,N-tetramethylenephosphonic acid, ethylenediamine -di(o-hydroxyphenylacetic acid) and salts thereof]; fluorescent brighteners such as 4,4'-diamino-2,2'-disulfostilbene compounds; and various surfactants such as alkylsulfonic acids, arylsulfonic acids, aliphatic carboxylic acids and aromatic carboxylic acids.

In the present invention, it is preferred that the color developing solutions are substantially free from benzyl alcohol. "Substantially free from benzyl alcohol" means that benzyl alcohol is contained preferably in an amount of 2 ml/l or less, more preferably in an amount of 0.5 ml/l or less, and most preferably no benzyl alcohol is contained in the developer solution. In the present invention, it is preferred that the color developing solutions are substantially free from sulfite ions. "Substantially free from sulfite ions" means that sulfite ions are contained preferably in an amount of $3.0\times10^{-3}$ mol/l or less, and more preferably no sulfite ions are contained in the developer solution.

In the present invention, it is preferred that the color developing solutions are substantially free from hydroxylamine. "Substantially free from hydroxylamine" means that hydroxylamine is contained preferably in an amount of $5.0\times10^{-3}$ mol/l or less, and more preferably no hydroxylamine is contained in the developer solution. In the present invention, it is preferred that the color developing solutions contain organic preservatives other than hydroxylamine (for example, hydroxylamine derivatives and hydrazine derivatives).

The pH of these color developing solutions is generally 9 to 12.

In general, black-and-white development, washing or rinsing, reversal processing and color development are carried out as color reversal development. In the reversal processing stage, a reversal bath containing a fogging agent may be used, or light reversal processing may be performed. The reversal processing stage may also be omitted by using a color developing solution containing the above-described fogging agent.

Black-and-white developing solutions used for the black-and-white development are ones used for treatment of conventional black-and-white photographic materials, and may contain various additives which are generally added to the black-and-white developing solutions.

Typical examples of such additives include developing agents such as 1-phenyl-3-pyrazolidone, N-methyl-p-aminophenol and hydroquinone; preservatives such as sulfites; pH buffers comprising water-soluble acids such as acetic acid and boric acid; pH buffers or development accelerators comprising alkali compounds such as sodium carbonate and potassium carbonate; inorganic or organic development inhibitors such as potassium bromide, 2-methylbenzimidazole and methyl benzthiazole; water softeners such as ethylenediaminetetraacetic acid and polyphosphates; antioxidants such as ascorbic acid and diethanolamine; organic solvents such as triethylene glycol and cellosolves; and surface overdevelopment inhibitors such as slight amounts of iodides and mercapto compounds.

The replenishment rate of these developing solutions varies depending on the type of color photographic material to be treated, but is usually not more than 3 liters per square meter of photographic sensitive material. By reducing the ion concentration of the bromide in the. replenisher, the replenishment rate can also be decreased to 500 ml/m$^2$ or less. When the replenishment rate is decreased, it is preferred to reduce the contact area of the processing solution with air to prevent the solution from evaporation and air oxidation. Methods for reducing the contact area of the processing solution with air like this include the method using the movable cover described in JP-A-1-82033 and the slit developing method described in JP-A-63-216050, as well as a method in which a shield such as a floating cover is provided on the surface of the photographic processing solution in the processing tank. This technique is preferably applied not only to both stages of color development and black-and-white development, but also to succeeding stages, for example, all stages of bleaching, bleach-fixing treatment, fixing, washing with water, stabilizing and the like. The replenishment rate can also be decreased by depressing accumulation of the bromide ions in the developing solution.

The time of the color development processing is usually established between 2 minutes and 5 minutes. However, an elevated temperature, a higher pH and the use of an color developing solution high in concentration can further reduce the processing time.

After color development, the photographic emulsion layer is desilverized. In desilverization, bleaching may be carried out separately or simultaneously with fixing (bleach-fixing treatment). The bleach-fixing treatment may be conducted after bleaching to expedite processing. A treatment with a bleach-fixing bath composed of two consecutive tanks, fixing prior to the bleach-fixing treatment, or bleaching after the bleach-fixing treatment may be arbitrarily carried out depending on the purpose.

Examples of bleaching agents used for the bleaching solutions or the bleach-fixing solutions include iron salts; compounds of polyvalent metals such as iron (III), cobalt (III), chromium (IV) and copper (II); peroxy acids; quinones; and nitro compounds. Typical examples of the bleaching agents include iron chlorides, ferricyanides, bichromates, organic complexes of iron (III) (for example, complex salts of iron (III) with aminopolycarboxylic acids such as ethylenediaminetetraacetic acid, diethylenetriaminepentaacetic acid, cyclohexanediaminetetraacetic acid, methyliminodiacetic acid, 1,3-diaminopropanetetraacetic acid and glycol ether diaminetetraacetic acid), persulfates, bromates, permanganates and nitrobenzene compounds. Of these, the iron (III) complex salts of aminopolycarboxylic acids including the iron (III) complex salt of ethylenediaminetetraacetic acid and the iron (III) complex of 1,3-diaminopropanetetraacetic acid are preferable from the viewpoint of rapid processing and prevention of environmental pollution. Further, the iron (III) complex salts of aminopolycarboxylic acids are also particularly useful for both the bleaching solutions and the bleach-fixing solutions. The bleaching solutions or the bleach-fixing solutions using these iron (III) complex salts of aminopolycarboxylic acids are used at a pH of 3.0 to 8.0.

Conventional additives may be added to the bleaching solutions or the bleach-fixing solutions. Examples of such additives include rehalogenating agents such as ammonium bromide and ammonium chloride, pH buffers such as ammonium nitrate, and metal-corrosion inhibitors such as ammonium sulfate.

For the purpose of preventing bleach stains, it is preferred that the bleaching solution or the bleach fixing solutions contain organic acids, as well as the above-described compounds. Particularly preferred organic acids are compounds having an acid dissociation constant (pKa) of 2 to 5.5, and specifically, acetic acid and propionic acid are preferable.

Fixing agents used in the fixing solutions or the bleach-fixing solutions include thiosulfates, thiocyanates, thioether compounds, thioureas and large quantities of iodides. The thiosulfates are generally used, and particularly ammonium thiosulfate can be most widely used. It is also preferred to use the thiosulfates in combination with thiocyanates, thioether compounds or thioureas.

As preservatives for the fixing solutions or the bleach-fixing solutions, sulfites, bisulfites, carbonyl bisulfite addition compounds or sulfinic compounds described in European Patent 294769A can be advantageously used. Furthermore, for the purpose of stabilizing the solutions, it is preferred to add various aminopolycarboxylic acids or organic phosphonic acids (for example, 1-hydroxyethylidene-1,1-diphosphonic acid and N,N,N',N'-ethylenediaminetetraphosphonic acid) to the fixing solutions or the bleach-fixing solutions.

The fixing solutions or the bleach-fixing solutions may further contain various fluorescent brighteners, antifoaming agents, surfactants, polyvinyl pyrrolidone and methanol.

Bleaching promoters may be added to the bleaching solutions, the bleach-fixing solutions and the preceding baths thereof, as required. Specific examples of the useful bleaching promoters include compounds having mercapto groups or disulfide groups described in U.S. Pat. No. 3,893,858, West German Patents 1,290,812 and 2,059,988, JP-A-53-32736, JP-A-53-57831, JP-A-53-37418, JP-A-53-72623,1 JP-A-53-95630, JP-A-53-95631, JP-A-53-104232, JP-A-53-124424, JP-A-53-141623, JP-A-53-28426 and *Research Disclosure*, No. 17129 (Jul., 1978); thiazolidine derivatives described in JP-A-50-140129; thiourea derivatives described in JP-B-45-8506, JP-A-52-20832, JP-A-53-32735 and U.S. Pat. No. 3,706,561; iodides described in West German Patent 1,127,715 and JP-A-58-16235; polyoxyethylene compounds described in West German Patents 966,410 and 2,748,430; polyamine compounds described in JP-B-45-8836; compounds described in JP-A-49-42434, JP-A-49-59644, JP-A-53-94927, JP-A-54-35727, JP-A-55-26506 and JP-A-58-163940; and bromide ions. Of these, the compounds having mercapto groups or disulfide groups are preferable from the view point of high promoting effect, and particularly the compounds described in U.S. Pat. No. 3,893,858, West German Patent 1,290,812 and JP-A-53-95630 are preferable. In addition, the compounds described in U.S. Pat. No. 4,552,834 are also preferable. These bleaching promoters may be added to the photographic materials. When the bleach-fixing treatment of color photographic materials for photographing is carried out, these bleaching promoters are particularly effective.

It is preferred that the total time of desilverization is short as long as poor desilverization does not take place. The time is preferably 1 to 3 minutes. The treating temperature is 25° to 50° C., and preferably 35° to 45° C.

In the desilverization stage, it is preferred that stirring is performed as fully as possible. Specific methods for performing stirring fully include the method described in JP-A-62-183460 and JP-A-62-183461 in which a jet of a processing solution is collided with the surface of an emulsion layer of a photographic material; the method described in JP-A-62-183461 in which the stirring effect is enhanced by using rotary means; the method of transferring a photographic material while bringing a wiper blade provided in a solution into contact with the surface of an emulsion layer to cause turbulence on the surface, thereby improving the stirring effect; and the method of increasing the circulating flow rate of a whole processing solution. Such means for improving the stirring effect is also effective for all of the bleaching solutions, the bleach-fixing solutions and the fixing solutions. It is conceivable that the improved stirring promotes the supply of the bleaching solutions and the fixing solutions. into the emulsion layers, which results in an increase in the rate of desilverization. The above-described means for improving the stirring effect is more effective when the bleaching promoters are used, and the promoting effect can be significantly increased or the fixing inhibition action due to the bleaching promoters can be removed.

It is preferred that automatic processors used for the photographic materials of the present invention have means for carrying the photographic materials which is described in JP-A-60-191257, JP-A-60-191258 and JP-A-60-191259. As described in JP-A-60-191257, such carrying means can remarkably reduce the amount of a processing solution brought from a preceding bath into a succeeding bath, and has the high effect of preventing the characteristics of the processing solution from deteriorating. Such an effect is particularly effective for a reduction in processing time in each stage or a decrease in the replenishment rate of the processing solution.

The color photographic materials of the present invention are usually subjected to washing with water after desilverization. Stabilization may be conducted instead of washing. In such stabilization, all of the conventional methods described in JP-A-57-8543, JP-A-58-14834 and JP-A-60-220345 can be used. Further, washing stabilization represented by the treatment of color photographic materials for photographing may be carried out, in which a stabilization bath containing a dye stabilizer and a surfactant is used as the final bath.

Rinsing solutions and stabilizing solutions may contain water softeners such as inorganic phosphoric acids, polyaminocarboxylic acids and organic aminophosphonic acids; metal salts such as Mg salts, Al salts and Bi salts; surfactants; and hardeners.

The amount of rinsing water used in the washing stage can be widely established depending on the characteristics of the photographic sensitive materials (for example, depending on materials used such as couplers), the use, the temperature of the rinsing water, the number of rinsing tanks (the number of stages), the replenishing system (countercurrent or direct flow) and other various conditions. Of these, the relationship between the amount of the rinsing water and the number of the rinsing tanks in the multistage countercurrent system can be determined by the method described in *Journal of the Society of Motion Picture and Television Engineers*64, 248–253 (May, 1955). When the amount of the rinsing water is substantially reduced in the multistage countercurrent system, a problem is encountered such that bacteria propagate in the water and the resulting suspended matter adheres on the photographic sensitive materials. In order to solve such a problem the method for reducing calcium ions and magnesium ions described in JP-A-62-288838 is very effectively used. There are also used isothiazolone compounds and thiapentazoles described in JP-A-57-8542; chlorine disinfectants such as chlorinated sodium isocyanurate; benzotriazole; and disinfectants described in Hiroshi Horiguchi, *Chemistry of Bacteria Prevention and Fungus Prevention*, Sankyo Shuppan (1986), *Sterilization, Pasteurization and Fungus Prevention Techniques of Microorganisms*, edited by Eisei Gijutsukai (1982) and *Dictionary of Disinfectants and Fungicides*, edited by Kogyo Gijutsukai and Nippon Bohkin Bohbai Gakkai (1986).

The pH of the rinsing water is 4 to 9, and preferably 5 to 8. The temperature of the rinsing water and washing time can also be variously established depending on the characteristics of the photographic materials, the use thereof, and the like. In general, however, a temperature of 15° to 45° C. and a time of 20 seconds to 10 minutes, preferably 25° to 40° C., and 30 seconds to 5 minutes, are selected.

The dye stabilizers which can be used for the stabilizing solutions include aldehydes such as formalin and glutaraldehyde, N-methylol compounds, hexamethylenetetramine and adducts of aldehydes and sulfurous acid. The stabilizing solutions may further contain pH adjusting buffers such as boric acid and sodium hydroxide; chelating agents such as 1-hydroxyethylidene -1,1-diphosphonic acid and ethylenediaminetetraacetic acid: antisulfurizing agents such as alkanolamine; fluorescent brighteners; and antifungal agents.

Overflow solutions derived from the abovedescribed washing and/or replenishment of the stabilizing solutions can be reclaimed in other stages such as the desilverization stage.

When each processing solution is concentrated by evaporation during processing using an automatic processor, it is preferred to add water to correct the concentration.

The photographic materials of the present invention may contain the color developing agents in order to simplify and expedite processing. It is preferred that various precursors of the color developing agents are added to the photographic materials. Examples of such precursors include indoaniline compounds described in U.S. Pat. No. 3,342,597; Schiff base type compounds desgribed in U.S. Pat. No. 3,342,599, *Research Disclosure*, No.14,850 and *ibid.*, No. 15,159; aldol compounds described in *Research Disclosure*, No. 13,924; metal salt complexes described in U.S. Pat. No. 3,719,492; and urethane compounds described in JP-A -53-135628.

The photographic materials of the present invention may contain various 1-phenyl-3-pyrazolidones for the purpose of promoting color development, as required.. Typical compounds thereof are described in JP-A-56-64339, JP-A-57-144547 and JP-A-58-115438.

Various processing solutions for treating the photographic materials of the present invention are used at a temperature of 10° to 50° C. The standard temperature is usually 33° to 38° C. The temperature may be elevated higher to expedite processing, whereby the processing time can be shortened. On the contrary, the temperature can be decreased lower to achieve improvements in image quality and in stability of the processing solutions. Further, to save silver of the photographic materials, processing may be conducted using cobalt intensification or hydrogen peroxide intensification described in West German Patent 2,226,770 or U.S. Pat. No. 3,674,499.

The present invention will be further illustrated in greater detail.with reference to the following examples, which are, however, not to be construed as limiting the invention.

EXAMPLE 1

Cellulose triacetate supports having an underlayer were coated with two layers consisting of an emulsion layer and a protective layer having the following compositions. Thus, photographic materials (samples 101 to 110) developing a monochromatic color were prepared. The numerical values indicate amounts in mol/m$^2$ for the couplers, and in g/m$^2$ for the compounds other than the couplers. For the silver halide, the numerical value indicates an amount converted to silver.

| Emulsion Layer | |
|---|---|
| Silver Chlorobromide Emulsion (cubic, 0.88 μm in mean grain size, 0.08 in coefficient of variation in grain size distribution, containing 0.2 mol % of silver bromide localized on a part of the surface of grains) | 0.30 |
| Gelatin | 1.86 |
| Coupler (see Table 1) | $5.0 \times 10^{-4}$ mol |
| High Boiling Solvent (see Table 1) | 2.0 |
| Protective Layer | |
| Gelatin | 1.33 |
| Acrylic Modified Copolymer of Polyvinyl Alcohol (degree of modification: 17%) | 0.17 |
| Liquid paraffin | 0.03 |
| Sodium Salt of 1-Oxy-3,5-dichloro-s-triazic Acid | 0.22 |

Samples 101 to 111 thus prepared were subjected to radiation exposure through a continuous density wedge by using a sensitometer (Fuji Photo Film Co., Ltd., FWH type, color temperature of light source: 3,200° K).

Then, the samples were processed by the following processing stages.

| Processing Stage | Temperature (°C.) | Time (sec) |
|---|---|---|
| Color Development | 35 | 45 |
| Bleach-Fixing | 30–35 | 45 |
| Rinsing (1) | 30–35 | 20 |
| Rinsing (2) | 30–35 | 20 |
| Rinsing (3) | 30–35 | 20 |
| Drying | 70–80 | 60 |

The composition of each processing solution was as follows:

| | Tank Solution |
|---|---|
| Color Developing Solution | |
| Water | 800 ml |
| Ethylenediamine-N,N,N,N-tetramethylenephosphonic Acid | 1.5 g |
| Potassium Bromide | 0.015 g |
| Triethanolamine | 8.0 g |
| Sodium Chloride | 1.4 g |
| Potassium Carbonate | 25 g |
| N-Ethyl-N-(β-methanesulfonamidoethyl)-3-methyl-4-aminoaniline Sulfate | 5.0 g |
| N,N-Bis(carboxymethyl)hydrazine | 5.5 g |
| Fluorescent Brightener (WHITEX 4B, Sumitomo Chemical Co., Ltd.) | 1.0 g |
| Water to make | 1000 ml |
| pH (25° C.) | 10.05 |
| Bleach-Fixing Solution | |
| Water | 400 ml |
| Ammonium Thiosulfate (70%) | 100 ml |
| Sodium Sulfite | 17 g |
| Ethylenediaminetetraacetic Acid Fe (III) Ammonium | 55 g |
| Disodium Ethylenediaminetetraacetate | 5 g |
| Ammonium Bromide | 40 g |
| Water to make | 1000 ml |
| pH (25° C.). | 6.0 |

Rinsing Solution

Iron-Exchange water (the content of each of calcium and magnesium being not mroe than 3 ppm.)

For example 101 to 111 in which color was developed in the processing stages, the density of developed cyan and yellow colors was measured by using a Fuji type densitometer. Table 1 shows the maximum cyan density (Dmax R), the maximum yellow density (Dmax B) and the side absorption factor represented by the following equation:

pti Side absorption factor=Dmax B/Dmax R

TABLE 1

| Sample No. | Coupler | High Boiling Solvent | DmaxR | DmaxB | Side Absorption Factor |
|---|---|---|---|---|---|
| 101 | Coupler A for Comparison | HBS-1 | 1.30 | 0.26 | 0.20 |
| 102 | Coupler A for Comparison | HBS-2 | 1.55 | 0.39 | 0.25 |
| 103 | Coupler B for Comparison | HBS-1 | 1.25 | 0.24 | 0.19 |
| 104 | Coupler B for Comparison | HBS-2 | 1.51 | 0.32 | 0.21 |
| 105 | Example Coupler (14) | HBS-1 | 2.09 | 0.33 | 0.16 |
| 106 | Example Coupler (14) | HBS-2 | 2.55 | 0.28 | 0.11 |
| 107 | Example Coupler (1) | HBS-2 | 2.41 | 0.28 | 0.12 |
| 108 | Example Coupler (2) | HBS-2 | 2.39 | 0.25 | 0.10 |
| 109 | Example Coupler (3) | HBS-2 | 2.51 | 0.26 | 0.10 |
| 110 | Example Coupler (4) | HBS-2 | 2.45 | 0.23 | 0.09 |
| 111 | Example Coupler (24) | HBS-2 | 2.53 | 0.27 | 0.11 |

Coupler A for Comparison

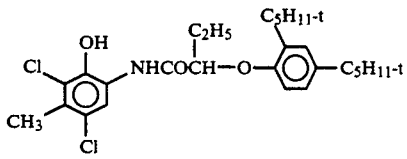

Coupler B for Comparison

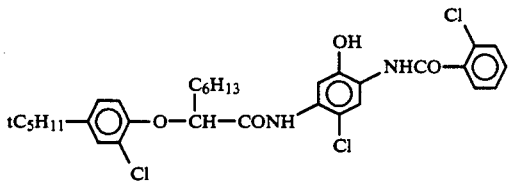

HBS-1

Tricresyl Phosphate

HBS-2

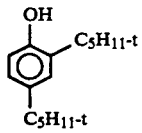

The results shown in Table 1 reveal that the cyan couplers of the present invention give preferable color images having little side absorption in the yellow regions of the formed cyan dyes.

Further, these results indicate that the maximum cyan density can be increased without increasing the maximum yellow density when phenol is used as the high boiling solvent.

EXAMPLE 2

A paper support both sides of which were laminated with polyethylene was subjected to corona discharge treatment and then provided with a gelatin underlayer containing sodium dodecylbenzenesulfonate. Various photographic constituent layers were further applied thereto. Thus, multilayer color photographic paper samples 201 to 208 having the following layer constitution were prepared. Coating solutions were prepared as follows:

Preparation of Coating Solution for First Layer 27.2 ml of ethyl acetate, 4.1 g of solvent (Solv-3) and 4.1 g of solvent (Solv-7) were added to 19.1 g of yellow coupler (ExY), 4.4 g of color image stabilizer (Cpd-1) and 0.7 g of color image stabilizer (Cpd-7) to dissolve them. The resulting solution was emulsified and dispersed in 185 ml of 10% gelatin solution containing 8 ml of 10% sodium dodecylbenzenesulfonate to prepare emulsified dispersion A. In the meantime, silver chlorobromide emulsion A (cubic; a 3:7 mixture (Ag mol ratio) of large-sized emulsion A having a mean grain size of 0.88 μm and small-sized emulsion A having a mean grain size of 0.70 μm; 0.08 and 0.10, respectively, in coefficient of variation in grain size distribution; each emulsion containing 0.3 mol % of silver bromide localized on a part of the surface of grains) was prepared, to which each of the following blue-sensitizing dyes A and B was added in an amount of $2.0\times10^{-4}$ mol for large-sized emulsion A and in an amount of $2.5\times10^{-4}$ mol for small-sized emulsion A. Chemical ripening of this emulsion was conducted by adding a sulfur sensitizer and a gold sensitizer. The above described emulsified dispersion A and this silver chlorobromide emulsion A were mixed with each other to prepare a coating solution for a first layer so as to have the composition shown in the following layer constitution.

Coating solutions for the second to the seventh layers were prepared similarly with the coating solution for the first layer. As a gelatin hardener for each layer, a sodium salt of 1-oxy-3,5-dichloro-s-triazine was used.

Cpd-10 and Cpd-11 were added to each layer to a total amount of 25.0 mg/m$^2$ and 50.0 mg/m$^2$, respectively.

In the silver chlorobromide emulsion of each light-sensitive emulsion layer, the following color sensitizing dyes were used.

Color Sensitizing Dye A for Blue-Sensitive Emulsion Layer:

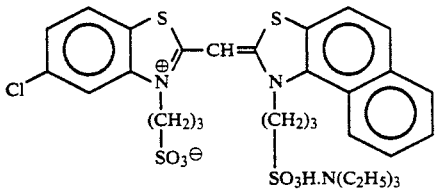

Color Sensitizing Dye B for Blue-Sensitive Emulsion Layer:

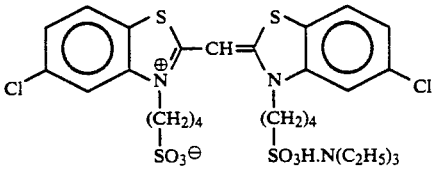

($2.0 \times 10^{-4}$ mol per mol of silver halide, respectively, for large-sized emulsion A, and $2.5 \times 10^{-4}$ mol per mol of silver halide, respectively, for small-sized emulsion A)

Color Sensitizing Dye C for Green-Sensitive Emulsion Layer:

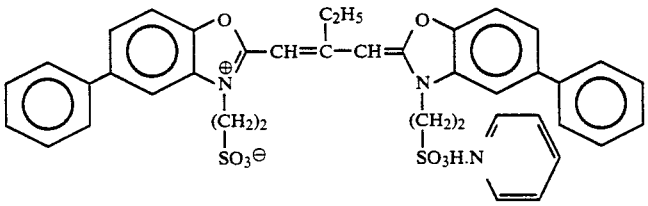

($4.0 \times 10^{-4}$ mol per mol of silver halide for large-sized emulsion B, and $5.6 \times 10^{-4}$ mol per silver halide for small-sized emulsion B)

Color Sensitizing Dye D for Green-Sensitive Emulsion Layer:

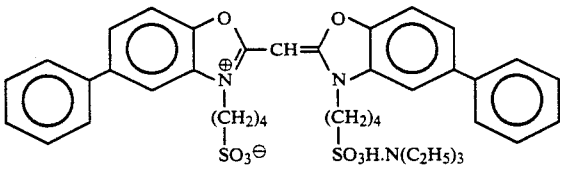

($7.0 \times 10^{-5}$ mol per mol of silver halide for large-sized emulsion B, and $1.0 \times 10^{-5}$ mol per mol of silver halide for small-sized emulsion B)

Color Sensitizing Dye E for Red-Sensitive Emulsion Layer:

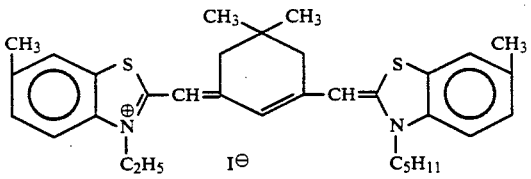

($0.9 \times 10^{-4}$ mol per mol of silver halide for large-sized emulsion C, and $1.1 \times 10^{-4}$ mol per mol of silver halide for small-sized emulsion C)

To the red-sensitive emulsion layer was added the follwoing compound in an amount of $2.6 \times 10^{-3}$ mol per mol of silver halide:

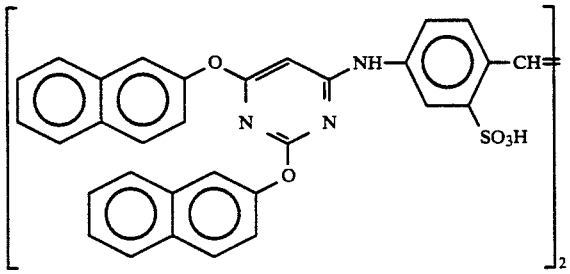

Further, 1-(5-methylureidophenyl)-5-mercaptotetrazole was added to the blue-sensitive emulsion layer, the green-sensitive emulsion layer and the red-sensitive emulsion layer in amounts of $8.5 \times 10^{-5}$ mol, $7.7 \times 10^{-4}$ mol and $2.5 \times 10^{-4}$ mol per mol of silver halide, respectively.

Furthermore, 4-hydroxy-6-methyl-1,3,3a, 7-tetraazainedene was added to the blue-sensitive emulsion layer and the green-sensitive emulsion layer in amounts of $1 \times 10^{-4}$ and $2 \times 10^{-4}$ mol per mol of silver halide, respectively.

The following dyes were added to each emulsion layer for prevention of irradiation (the numerical values in parentheses indicate the total coated weights per $m^2$ of the photographic material):

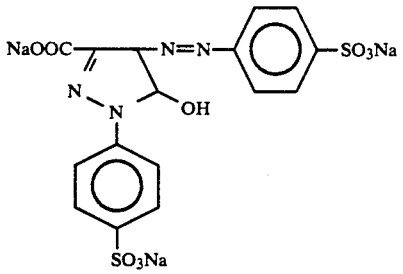

(10 mg/m²)

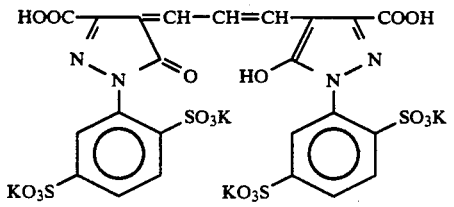

(10 mg/m²)

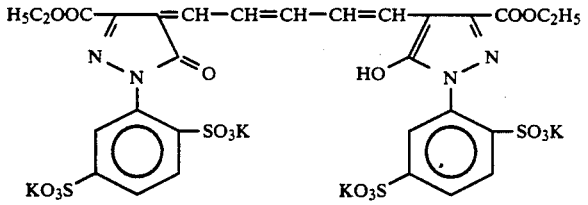

(40 mg/m²)

and

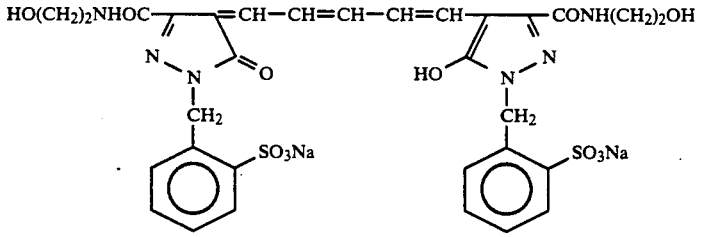

(20 mg/m²)

Layer Constitution

The composition of each layer is hereinafter shown. The numerals indicate coated weights (g/m²). For the silver halide emulsions, the numerals indicate coated weights converted to silver.

Support

Paper laminated with polyethylene (polyethylene on the side of the first layer contaning a white pigment ($TiO_2$) and a bluing dye (ultramarine))

| | |
|---|---|
| First Layer (Blue-Sensitive Emulsion Layer) | |
| Silver Chlorobromide Emulsion A Described Above | 0.30 |
| Gelatin | 1.86 |
| Yellow Coupler (ExY) | 0.82 |
| Color Image Stabilizer (Cpd-1) | 0.19 |
| Solvent (Solv-3) | 0.18 |
| Solvent (Solv-7) | 0.18 |
| Color Image Stabilzer (Cpd-7) | 0.06 |
| Second Layer (Color Mixing Preventing Layer) | |
| Gelatin | 0.99 |
| Color Mixing Inhibitor (Cpd-5) | 0.08 |
| Solvent (Solv-1) | 0.16 |
| Solvent (Solv-4) | 0.08 |

-continued

| | |
|---|---|
| Third Layer (Green-Sensitive Emulsion Layer) | |
| Silver Chlorobromide Emulsion (cubic; a 1:3 mixture (Ag mol ratio) of large-sized emulsion B having a mean grain size of 0.55 μm and small-sized emulsion B having a mean grain size of 0.39 μm; 0.10 and 0.08, respectively, in coefficient of variation in grain size distribution; each emulsion containing 0.8 mol % of silver bromide localized on a part of the surface of grains) | 0.12 |
| Gelatin | 1.24 |
| Magenta Coupler (ExM) | 0.23 |
| Color Image Stabilizer (Cpd-2) | 0.03 |
| Color Image Stabilizer (Cpd-3) | 0.16 |
| Color Image Stabilizer (Cpd-4) | 0.02 |
| Color Image Stabilizer (Cpd-9) | 0.02 |
| Solvent (Solv-2) | 0.40 |
| Fourth Layer (Ultraviolet Light Absorbing Layer) | |
| Gelatin | 1.58 |
| Ultraviolet Light Absorber (UV-1) | 0.47 |
| Color Mixing Inhibitor (Cpd-5) | 0.10 |
| Solvent (Solv-5) | 0.24 |
| Fifth Layer (Red-Sensitive Emulsion Layer) | |
| Silver Chlorobromide Emulsion (cubic; a 1:4 mixture (Ag mol ratio) of large-sized emulsion C having a mean grain size of 0.58 μm and small-sized emulsion C having a mean grain size of 0.45 μm; 0.09 and 0.11, respectively, in coefficient of variation in grain size distribution; each emulsion containing 0.6 mol % of silver bromide localized on a part of the surface of grains) | 0.23 |
| Gelatin | 1.34 |
| Cyan Coupler (see Table 2) | $6.5 \times 10^{-4}$ mol |
| Color Image Stabilizer (Cpd-2) | 0.03 |
| Color Image Stabilizer (Cpd-4) | 0.02 |
| Color Image Stabilizer (Cpd-6) | 0.01 |
| Color Image Stabilizer (Cpd-7) | 0.01 |
| Color Image Stabilizer (Cpd-8) | 0.01 |
| Solvent (Solv-6) | 0.14 |
| Sixth Layer (Ultraviolet Light Absorbing Layer) | |
| Gelatin | 0.53 |
| Ultraviolet Light Absorber (UV-1) | 0.16 |
| Color Mixing Inhibitor (Cpd-5) | 0.02 |
| Solvent (Solv-5) | 0.08 |
| Seventh Layer (Protective Layer) | |
| Gelatin | 1.33 |
| Acrylic Modified Copolymer of Polyvinyl Alcohol (degree of modification: 17%) | 0.17 |
| Liquid paraffin | 0.03 |

(ExY) Yellow Coupler:

A 1:1 mixture (mol ratio) of

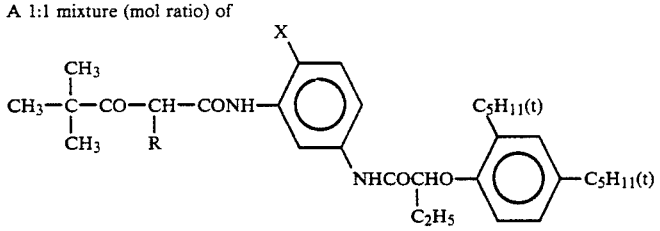

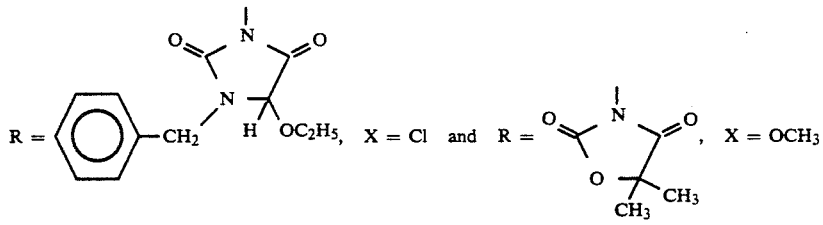

(ExM) Magenta Coupler

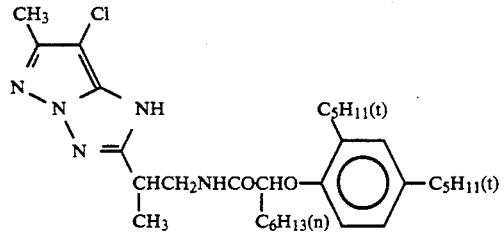

-continued
(Cpd-1) Color Image Stabilizer:
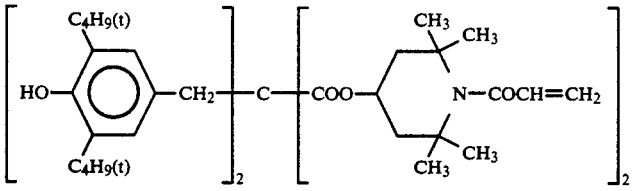
(Cpd-2) Color Image Stabilizer:
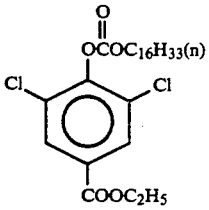
(Cpd-3) Color Image Stabilizer:
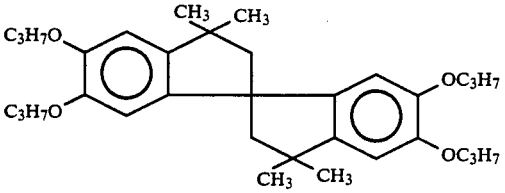
(Cpd-4) Color Image Stabilizer:
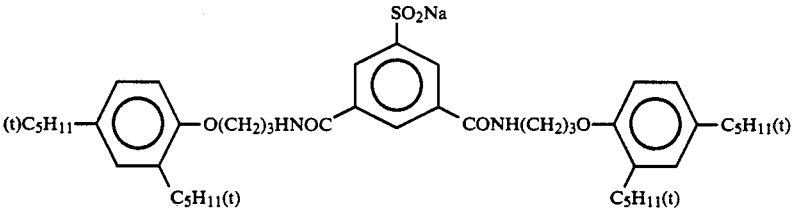
(Cpd-5) Color Mixing Inhibitor:
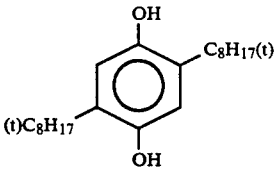
(Cpd-6) Color Image Stabilizer:
A 2:4:4 mixture (weight ratio) of
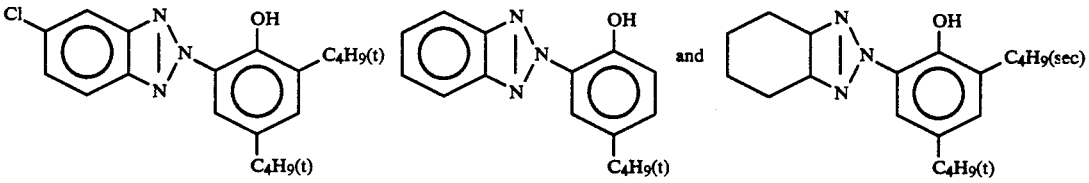
(Cpd-7) Color Image Stabilizer:
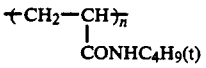
(Molecular weight 60,000)
(Cpd-8) Color Image Stabilizer:
A 1:1 mixture (weight ratio) of -continued
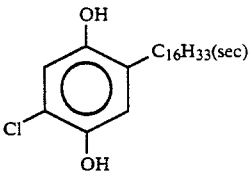
and
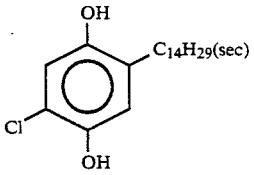
(Cpd-9) Color Image Stabilizer:
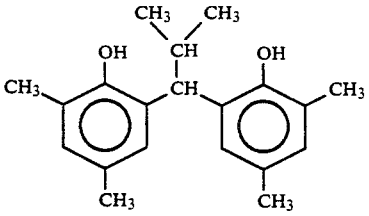
(Cpd-10) Preservative
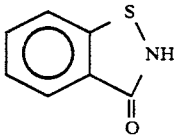
(Cpd-11) Preservative
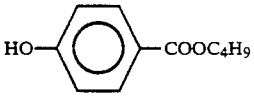
(UV-1) Ultraviolet Light Absorber:
A 4:2:4 mixture (weight ratio) of
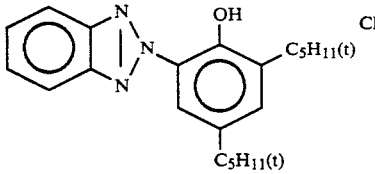
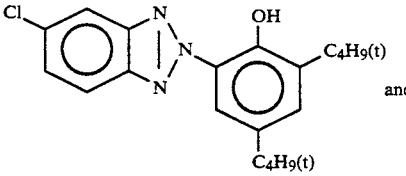
and
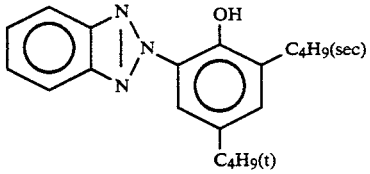
(Solv-1) Solvent:
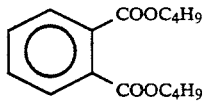
(Solv-2) Solvent:
A 1:1 mixture (volume ratio) of
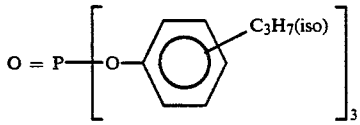
and
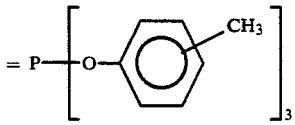
(Solv-3) Solvent 1:
$O = P[O-C_9H_{19}(iso)]_3$
(Solv-4) Solvent:
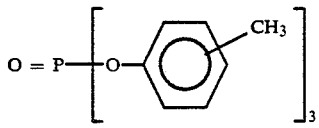
(Solv-5) Solvent -continued $COOC_8H_{17}$
|
$(CH_2)_8$
|
$COOC_8H_{17}$ (Solv-6) Solvent:

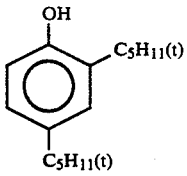

(Solv-7) Solvent:

$C_8H_{17}CHCH(CH_2)_7COOC_8H_{17}$
\ /
O

Each of the samples was subjected to radiation exposure using red light.

As to the samples for which the exposure was completed, continuous processing (running test) was carried out according to the following processing stages using a paper processor until the replenishment rate of the processing solutions reached twice the tank capacity of the color development.

| Processing Stage | Temperature (°C.) | Time (sec) | Replenisher* (ml) | Capacity (liter) |
|---|---|---|---|---|
| Color Development | 35 | 45 | 161 | 17 |
| Bleach-Fixing | 30–35 | 45 | 215 | 17 |
| Rinsing (1) | 30–35 | 20 | — | 10 |
| Rinsing (2) | 30–35 | 20 | — | 10 |
| Rinsing (3) | 30–35 | 20 | 350 | 10 |
| Drying | 70–80 | 60 | | |

*Replenishment rate: per $m^2$ of light-sensitive material (Three tank countercurrent system from rinsing (3) to rinsing (1) was employed.)

The composition of each processing solution was as follows:

| Color Developing Solution | Tank Solution | Replenisher |
|---|---|---|
| Water | 800 ml | 800 ml |
| Ethylenediamine-N,N,N',N'-tetramethylenephosphonic Acid | 1.5 g | 2.0 g |
| Triethanolamine | 8.0 g | 12.0 g |
| Sodium Chloride | 1.4 g | — |
| Potassium Carbonate | 25 g | 25 g |
| N-Ethyl-N-(β-methanesulfonamidoethyl)-3-methyl-4-aminoaniline Sulfate | 5.0 g | 7.0 g |
| N,N-Bis(carboxymethyl)hydrazine | 5.5 g | 7.0 g |
| Fluorescent brightener (WHITEX) 4B, Sumitomo Chemical Co., Ltd.) | 1.0 g | 2.0 g |
| Water to make | 1000 ml | 1000 ml |
| pH (25° C.) | 10.05 | 10.45 |

| Bleach-Fixing Solution (tank solution and replenisher being the same) | |
|---|---|
| Water | 400 ml |
| Ammonium Thiosulfate (70% aqueous solution) | 100 ml |
| Sodium Sulfite | 17 g |
| Ethylenediaminetetraacetic Acid Fe(III) Ammonium | 55 g |
| Disodium Ethylenediaminetetraacetate | 5 g |
| Ammonium Bromide | 40 g |
| Water to make | 1000 ml |

-continued

| | |
|---|---|
| pH (25° C.) | 6.0 |

Rinsing Solution (tank solution and replenisher being the same)

Ion-Exchange Water (the content of each of calcium and magnesium being not more than 3 ppm)

As to samples 201 to 208 in which cyan color was developed by the processing, the side absorption factor was determined similarly with Example 1. The results are shown in Table 2.

TABLE 2

| Sample No. | Coupler | Side Absorption Factor |
|---|---|---|
| 201 | Coupler A for Comparison | 0.26 |
| 202 | Coupler B for Comparison | 0.23 |
| 203 | Example Coupler (14) | 0.14 |
| 204 | Example Coupler (1) | 0.12 |
| 205 | Example Coupler (2) | 0.11 |
| 206 | Example Coupler (3) | 0.12 |
| 207 | Example Coupler (4) | 0.10 |
| 208 | Example Coupler (24) | 0.13 |

(Couplers A and B for Comparison are the same as those used in Example 1.)

The results shown in Table 2 reveal that the cyan couplers of the present invention povide excellent images having little side absorption in the yellow regions also for the multilayer color photographic materials.

EXAMPLE 3

Each of cellulose triacetate supports having an underlayer was coated with emulsion layers having each of the following compositions. Thus, samples 301 to 307 were prepared.

| First Layer: Antihalation Layer | |
|---|---|
| Black Colloidal Silver | 0.25 $g/m^2$ |
| Ultraviolet Light Absorber U-1 | 0.1 $g/m^2$ |
| Ultraviolet Light Absorber U-2 | 0.1 $g/m^2$ |
| High Boiling Organic Solvent Oil-1 | 0.1 $ml/m^2$ |
| Gelatin | 0.9 $g/m^2$ |

-continued

| Second Layer: Intermediate Layer-1 | |
|---|---|
| Cpd-D | 10 mg/m$^2$ |
| High Boiling Organic Solvent Oil-3 | 40 mg/m$^2$ |
| Gelatin | 0.40 g/m$^2$ |

| Third Layer: Intermediate Layer-2 | |
|---|---|
| Fogged Fine-Grained Silver Iodobromide Emulsion (mean grain size: 0.06 μm, AgI content: 1 mol %) | 0.05 g/m$^2$ silver amount |
| Gelatin | 0.4 g/m$^2$ |

| Fourth Layer: First Red-Sensitive Emulsion Layer | |
|---|---|
| Silver Iodobromide Emulsion EM-1 Spectrally Sensitized with Sensitizing Dyes S-1 and S-2 | 0.4 g/m$^2$ silver amount |
| Cyan Coupler (see Table 3) | $3.2 \times 10^{-4}$ mol/m$^2$ |
| High Boiling Organic Solvent Oil-1 | 0.3 ml/m$^2$ |
| Gelatin | 0.8 g/m$^2$ |

| Fifth Layer: Second Red-Sensitive Emulsion Layer | |
|---|---|
| Silver Iodobromide Emulsion EM-4 Spectrally Sensitized with Sensitizing Dyes S-1 and S-2 | 0.4 g/m$^2$ silver amount |
| Cyan Coupler (see Table 3) | $6.4 \times 10^{-4}$ mol/m$^2$ |
| Coupler C-2 | 0.05 g/m$^2$ |
| High Boiling Organic Solvent Oil-1 | 0.3 ml/m$^2$ |
| Gelatin | 0.8 g/m$^2$ |

| Sixth Layer: Third Red-Sensitive Emulsion Layer | |
|---|---|
| Silver Iodobromide Emulsion EM-7 Spectrally Sensitized with Sensitizing Dyes S-1 and S-2 | 0.4 g/m$^2$ silver amount |
| Cyan Coupler (see Table 3) | $1.1 \times 10^{-3}$ mol/m$^2$ |
| Coupler C-2 | 0.3 g/m$^2$ |
| High Boiling Organic Solvent Oil-1 | 0.3 ml/m$^2$ |
| Gelatin | 1.1 g/m$^2$ |

| Seventh Layer: Intermediate Layer-3 | |
|---|---|
| Dye D-1 | 0.02 g/m$^2$ |
| Gelatin | 0.6 g/m$^2$ |

| Eighth Layer: Intermediate Layer-4 | |
|---|---|
| Fogged Fine-Grained Silver Iodobromide Emulsion (mean grain size: 0.06 μm, AgI content: 0.3 mol %) | 0.06 g/m$^2$ silver amount |
| Compound Cpd-A | 0.5 g/m$^2$ |
| Gelatin | 1.0 g/m$^2$ |

| Ninth Layer: First Green-Sensitive Emulsion Layer | |
|---|---|
| Silver Iodobromide Emulsion EM-1 Spectrally Sensitized with Sensitizing Dyes S-3 and S-4 | 0.5 g/m$^2$ silver amount |
| Coupler C-4 | 0.10 g/m$^2$ |
| Coupler C-7 | 0.10 g/m$^2$ |
| Coupler C-8 | 0.10 g/m$^2$ |
| Compound Cpd-B | 0.03 g/m$^2$ |
| Compound Cpd-E | 0.1 g/m$^2$ |
| Compound Cpd-F | 0.1 g/m$^2$ |
| Compound Cpd-G | 0.05 g/m$^2$ |
| Compound Cpd-H | 0.05 g/m$^2$ |
| Gelatin | 0.5 g/m$^2$ |

| Tenth Layer: Second Green-Sensitive Emulsion Layer | |
|---|---|
| Silver Iodobromide Emulsion EM-4 Containing Sensitizing Dyes S-3 and S-4 | 0.4 g/m$^2$ silver amount |
| Coupler C-4 | 0.10 g/m$^2$ |
| Coupler C-7 | 0.10 g/m$^2$ |
| Coupler C-8 | 0.10 g/m$^2$ |
| Compound Cpd-B | 0.03 g/m$^2$ |
| Compound Cpd-E | 0.1 g/m$^2$ |
| Compound Cpd-F | 0.1 g/m$^2$ |
| Compound Cpd-G | 0.05 g/m$^2$ |
| Compound Cpd-H | 0.05 g/m$^2$ |
| Gelatin | 0.6 g/m$^2$ |

-continued

| Eleventh Layer: Third Green-Sensitive Emulsion Layer | |
|---|---|
| Silver Iodobromide Emulsion EM-7 Containing Sensitizing Dyes S-3 and S-4 | 0.5 g/m$^2$ silver amount |
| Coupler C-4 | 0.4 g/m$^2$ |
| Coupler C-7 | 0.2 g/m$^2$ |
| Coupler C-8 | 0.2 g/m$^2$ |
| Compound Cpd-B | 0.08 g/m$^2$ |
| Compound Cpd-E | 0.1 g/m$^2$ |
| Compound Cpd-F | 0.1 g/m$^2$ |
| Compound Cpd-G | 0.1 g/m$^2$ |
| Compound Cpd-H | 0.1 g/m$^2$ |
| Gelatin | 1.0 g/m$^2$ |

| Twelfth Layer: Intermediate Layer-5 | |
|---|---|
| Dye D-2 | 0.05 g/m$^2$ |
| Gelatin | 0.6 g/m$^2$ |

| Thirteenth Layer: Yellow Filter Layer | |
|---|---|
| Yellow Colloidal Silver | 0.1 g/m$^2$ |
| Compound Cpd-A | 0.01 g/m$^2$ |
| Gelatin | 0.1 g/m$^2$ |

| Fourteenth Layer: First Blue-Sensitive Emulsion Layer | |
|---|---|
| Silver Iodobromide Emulsion EM-1 Containing Sensitizing Dyes S-5 and S-6 | 0.6 g/m$^2$ silver amount |
| Coupler C-5 | 0.6 g/m$^2$ |
| Gelatin | 0.8 g/m$^2$ |

| Fifteenth Layer: Second Blue-Sensitive Emulsion Layer | |
|---|---|
| Silver Iodobromide Emulsion EM-4 Containing Sensitizing Dyes S-5 and S-6 | 0.4 g/m$^2$ silver amount |
| Coupler C-5 | 0.3 g/m$^2$ |
| Coupler C-6 | 0.3 g/m$^2$ |
| Gelatin | 0.9 g/m$^2$ |

| Sixteenth Layer: Third Blue-Sensitive Emulsion Layer | |
|---|---|
| Silver Iodobromide Emulsion EM-7 Containing Sensitizing Dyes S-5 and S-6 | 0.4 g/m$^2$ silver amount |
| Coupler C-6 | 0.7 g/m$^2$ |
| Gelatin | 1.8 g/m$^2$ |

| Seventeenth Layer: First Protective Layer | |
|---|---|
| Ultraviolet Light Absorber U-1 | 0.04 g/m$^2$ |
| Ultraviolet Light Absorber U-3 | 0.03 g/m$^2$ |
| Ultraviolet Light Absorber U-4 | 0.03 g/m$^2$ |
| Ultraviolet Light Absorber U-5 | 0.05 g/m$^2$ |
| Ultraviolet Light Absorber U-6 | 0.05 g/m$^2$ |
| Compound Cpd-C | 0.8 g/m$^2$ |
| Dye D-3 | 0.05 g/m$^2$ |
| Gelatin | 0.7 g/m$^2$ |

| Eighteenth Layer: Second Protective Layer | |
|---|---|
| Fogged Fine-Grained Silver Iodobromide Emulsion (mean grain size: 0.06 μm, AgI content: 1 mol %) | 0.1 g/m$^2$ silver amount |
| Gelatin | 0.4 g/m$^2$ |

| Nineteenth Layer: Third Protective Layer | |
|---|---|
| Polymethyl Methacrylate (mean grain size: 1.5 μm) | 0.1 g/m$^2$ |
| 4:6 (by weight) Copolymer of Polymethyl Methacrylate and Acrylic Acid having mean molecular weight of 30,000 (mean grain size: 1.5 μm) | 0.1 g/m$^2$ |
| Silicone Oil | 0.03 g/m$^2$ |
| Fluorine-Containing Surface Active Agent W-1 | 3 g/m$^2$ |
| Gelatin | 0.4 g/m$^2$ |

In addition to the above-described compounds, gelatin hardening agent H-1 and a surface active agent were added to each layer.

Emulsions EM-1, 4 and 7 used hereinabove were as follows:

| | AgBrI Emulsion | Mean Diameter (μm) | Coefficient Variation (%) | AgI Content (%) | Amount of Sensitizer (g/mol Ag) in each Light-Sensitive Layer: Red S-1 | Red S-2 | Green S-3 | Green S-4 | Blue S-5 | Blue S-6 |
|---|---|---|---|---|---|---|---|---|---|---|
| EM-1 | Monodisperse, Tetradecahedral grains | 0.28 | 16 | 3.7 | 0.025 | 0.25 | 0.5 | 0.1 | 0.05 | 0.2 |
| EM-2 | Monodisperse, Cubic, Internal latent image type grains | 0.30 | 10 | 3.3 | 0.01 | 0.25 | 0.25 | 0.08 | 0.06 | 0.22 |
| EM-3 | Monodisperse, Tabular grains (mean aspect ratio: 7.0) | 0.38 | 18 | 5.0 | 0.02 | 0.25 | 6.3 | 0.07 | 0.06 | 0.22 |

C-2

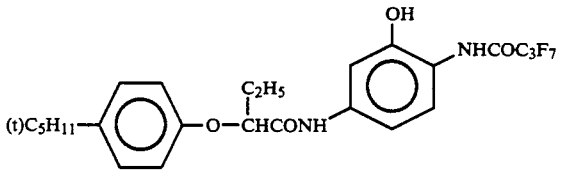

C-4

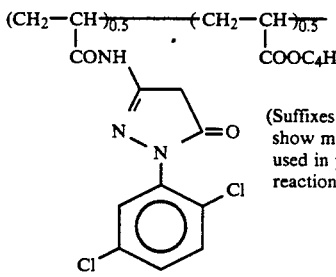

(Suffixes of parenthesis show molars of monomers used in polymerization reaction.)

C-5

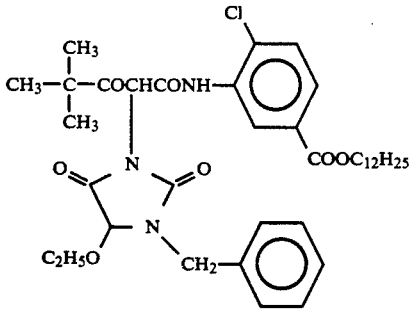

C-6

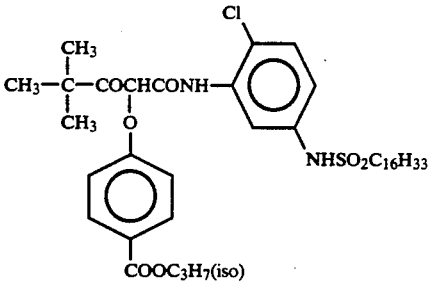

-continued
C-7
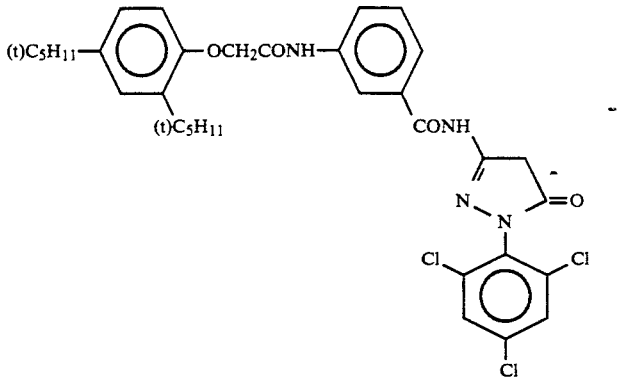
Coupler C-8
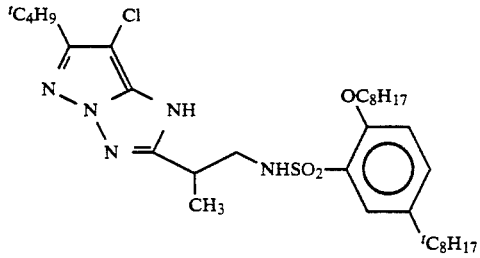
Oil-1
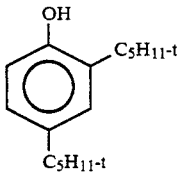
Oil-3
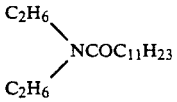
Cpd-A
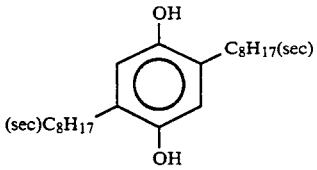
Cpd-B
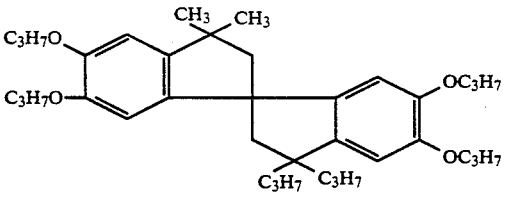
Cpd-C
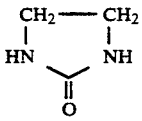
Cpd-D
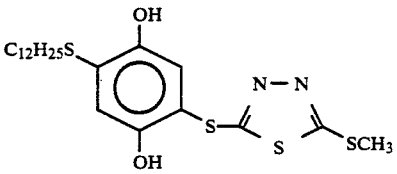

-continued
Cpd-E
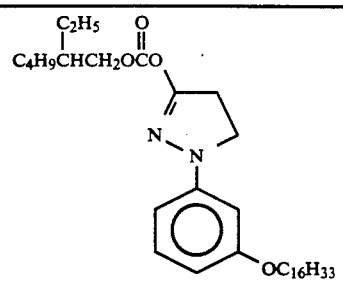
Cpd-F
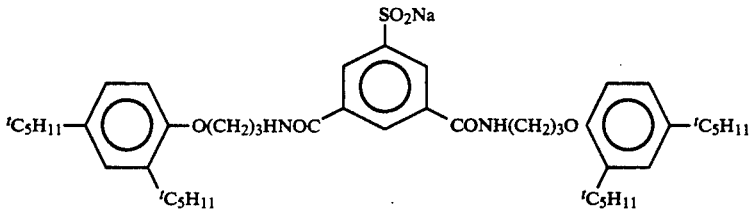
Cpd-G
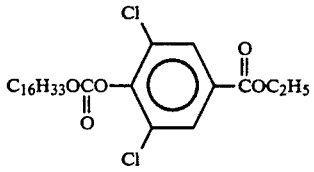
Cpd-H
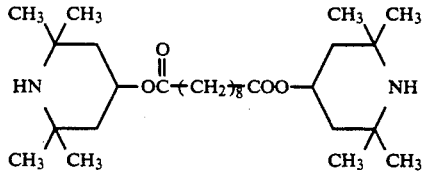
U-1
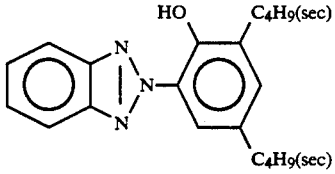
U-2
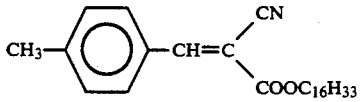
U-3
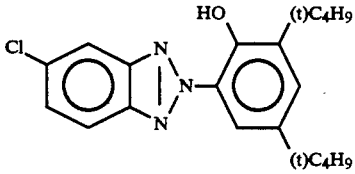
U-4
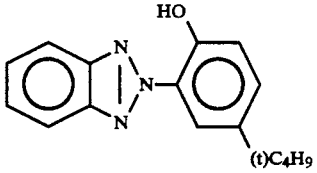
U-5
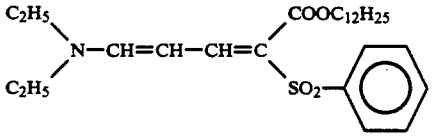

-continued
U-6
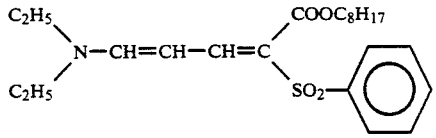
S-1
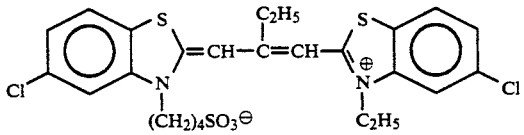
S-2
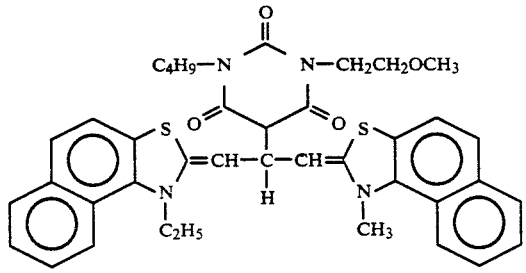
S-3
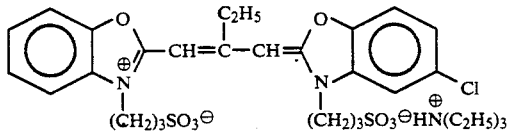
S-4
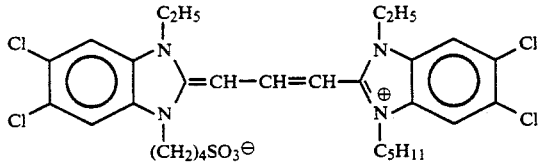
S-5
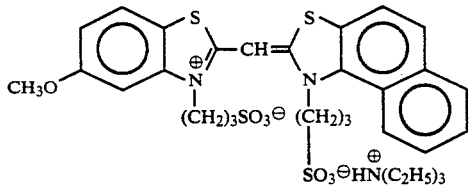
S-6
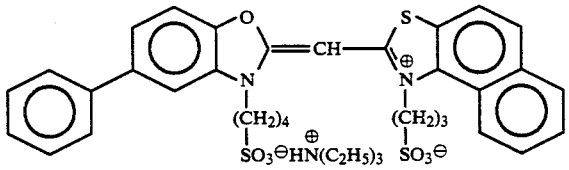
D-1
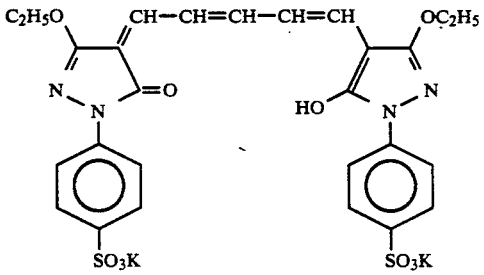

-continued

D-2

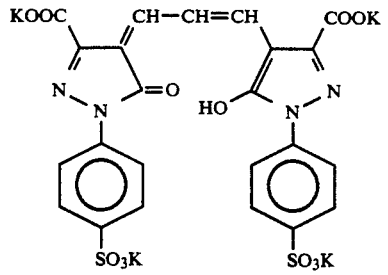

D-3

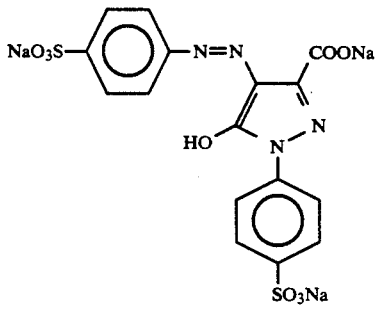

H-1

$$\begin{array}{l} CH_2{=}CHSO_2CH_2CONHCH_2 \\ \qquad\qquad\qquad\quad | \\ CH_2{=}CHSO_2CH_2CONHCH_2 \end{array}$$

W-1

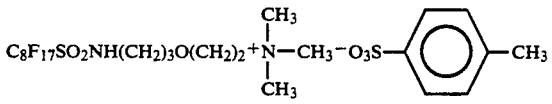

Samples 301 to 307 thus prepared were subjected to radiation exposure using red light, followed by processing according to the following processing stages:

| Processing Stages | | |
|---|---|---|
| Stage | Time (min) | Temperature (°C.) |
| First Development | 6 | 38 |
| Rinsing | 2 | 38 |
| Reversal | 2 | 38 |
| Color Development | 6 | 38 |
| Compensating | 2 | 38 |
| Bleaching | 6 | 38 |
| Fixing | 4 | 38 |
| Rinsing | 4 | 38 |
| Stabilizing | 1 | Ordinary temperature |
| Drying | 2 | 50 |

Processing solutions having the following composiitons were used.

| First Developing Solution | |
|---|---|
| Water | 700 ml |
| Pentasodium Salt of Nitrilo-N,N,N-trimethylenephosphonic Acid | 2 g |
| Sodium sulfite | 20 g |
| Hydroquinone monosulfonate | 30 g |
| Sodium Carbonate (Monohydrate) | 30 g |
| 1-Phenyl-4-methyl-4-hydroxymethyl-3-pyrazolidone | 2 g |
| Potassium Bromide | 2.5 g |
| Potassium Thiocyanate | 1.2 g |
| Potassium Iodide (0.1% Solution) | 2 ml |
| Water to make | 1000 ml |

-continued

| | |
|---|---|
| pH (25° C.) | 9.60 |
| **Reversal Solution** | |
| Water | 700 ml |
| Pentasodium Salt of Nitrilo-N,N,N-trimethylenephosphonic Acid | 3 g |
| Stannous Chloride (Dihydrate) | 1 g |
| p-Aminophenol | 0.1 g |
| Sodium Hydroxide | 8 g |
| Glacial Acetic Acid | 15 ml |
| Water to make | 1,000 ml |
| pH (25° C.) | 6.0 |
| **Color Developing Solution** | |
| Water | 700 ml |
| Pentasodium Salt of Nitrilo-N,N,N-trimethylenephosphonic Acid | 3 g |
| Sodium Sulfite | 7 g |
| Sodium Tertiary Phosphate (Dodecahydrate) | 36 g |
| Potassium Bromide | 1 g |
| Potassium Iodide (0.1% Solution) | 90 ml |
| Sodium Hydroxide | 3 g |
| Citrazinic Acid | 1.5 g |
| N-Ethyl-N-(β-methanesulfoniamidoethyl)-3-methyl-4-aminoaniline Sulfate | 11 g |
| 3,6-Dithiaoctane-1,8-diol | 1 g |
| Water to make | 1,000 ml |
| pH (25° C.) | 11.80 |
| **Compensating Solution** | |
| Water | 700 ml |
| Sodium Sulfite | 12 g |
| Sodium Ethylenediaminetetraacetate (Dihydrate) | 8 g |
| Thioglycerin | 0.4 g |
| Glacial Acetic Acid | 3 ml |
| Water to make | 1,000 ml |
| pH (25° C.) | 6.0 |

-continued

| Bleaching Solution | |
|---|---|
| Water | 800 ml |
| Sodium Ethylenediaminetetraacetate (Dihydrate) | 2 g |
| Ethylenediaminetetraacetic Acid Fe(III) Ammonium (Dihydrate) | 120 g |
| Potassium Bromide | 100 g |
| Water to make | 1,000 ml |
| pH (25° C.) | 5.70 |
| **Fixing Solution** | |
| Water | 800 ml |
| Sodium thiosulfate | 80.0 g |
| Sodium Sulfite | 5.0 g |
| Sodium Bisulfite | 5.0 g |
| Water to make | 1,000 ml |
| pH (25° C.) | 6.0 |
| **Stabilizing Solution** | |
| Water | 800 ml |
| Formalin (37% by weight) | 5.0 ml |
| Fuji Drywell (Surface Active Agent,) Manufactured by Fuji Photo Film Co., Ltd.) | 5.0 ml |
| Water to make | 1000 ml |
| pH (25° C.) | 7.0 |

As to samples 301 to 308 in which cyan color was developed in the processing stages, the side absorption factor was determined similarly with Example 1. The results are shown in Table 3.

TABLE 3

| Sample No. | Coupler | Side Absorption Factor |
|---|---|---|
| 301 | Coupler A for Comparison | 0.25 |
| 302 | Coupler C for Comparison | 0.24 |
| 303 | Example Coupler (14) | 0.17 |
| 304 | Example Coupler (1) | 0.16 |
| 305 | Example Coupler (2) | 0.14 |
| 306 | Example Coupler (3) | 0.15 |
| 307 | Example Coupler (4) | 0.13 |
| 308 | Example Coupler (24) | 0.16 |

Coupler C for Comparison

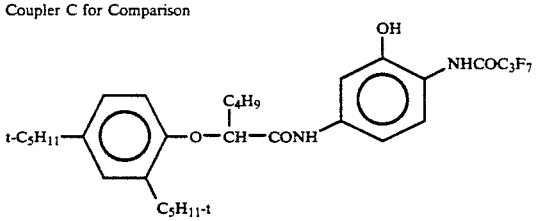

(Coupler A for Comparison is the same as that used in Example 1.)

the results shown in Table 3 reveal that the cyan couplers of the present invention provide preferred images having little side absorption in the yellow regions also for the color reversal photographic materials for photographing.

EXAMPLE 4

In a 300-ml three neck flask equipped with a stirrer, 2.6 mmol of coupler (4) of the present invention, 65 ml of chloroform and 50 ml of distilled water were placed, and 3.75 g of sodium carbonate, 0.81 g of developing agent R and 1.65 g of ammonium persulfate were added thereto in turn while stirring at room temperature. The reaction product showed a blue or bluish green color. After stirring at room temperature for 1 hour, the upper layer (aqueous layer) was discarded. Then, the product was thoroughly washed with a dilute aqueous solution of hydrochloric acid, followed by purification by silica gel column chromatography. After removal by distillation and drying, the product was further dried by a vacuum pump for 10 hours to obtain amorphous azomethine dye D-1.

Further, dye D-2 was obtained using Coupler A for Comparison instead of coupler (4).

Furthermore, dye D-3 was obtained using coupler (1) described in JP-A-1-315736.

R

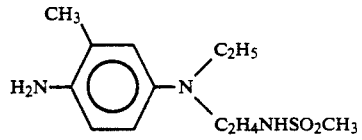

(D-1)

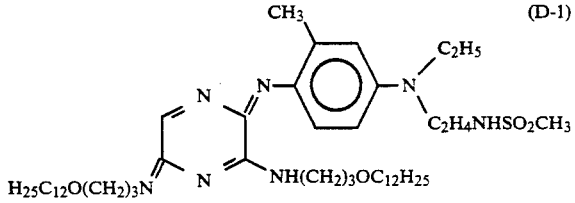

(D-2)

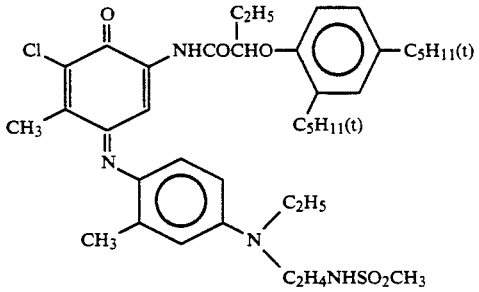

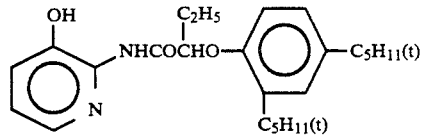

Coupler (1) for Comparison (described in JP-A-1-315736)

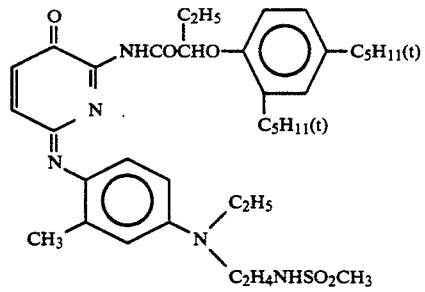

Each of azomethine dye D-1 of the present invention and dyes D-2 and D-3 for comparison was weighed and placed in an amount of 2.00 mg in each 100-ml measuring flask, and acetic acid (guaranteed reagent) was added thereto to dissolve it and the acetic acid was further added to the mark. After being homogenized by shaking gently, the mixture was placed in a 1 cm-thick quartz cell, and the visible absorption spectrum was measured by a spectrophotometer for ultraviolet and visible region (manufactured by Shimadzu Corporation). The visible absorption spectra of these dyes standardized so that the maximum absorption intensity becomes 1 are shown in FIG. 1. The solid line indicates the visible light absorption curve .of dye D-1, the broken lines 1 and 2 indicate that of dye D-2 and D-3, respectively.

As apparent from FIG. 1, cyan dye D-1 formed by the coupler of the present invention provides a sharper absorption spectrum significantly reduced in asymmetric absorption on the short wavelength side of the red wavelength region, namely in he blue and green regions, compared to the spectra of dyes D-2 and D-3 for comparison. It can be therefore understood that the hue of dye D-1 is clearer.

When the cyan couplers of the present invention are used, images having little side absorption in the yellow region of the cyan dyes form and have a good cyan hue.

While the invention has been described in detail and with reference to specific embodiments thereof, it will be apparent to one skilled in the art that various changes and modifications can be made therein without departing from the spirit and scope thereof.

What is claimed is:

1. A silver halide color photographic material comprising a support and at least one photosensitive silver halide emulsion layer formed on siad support, wherein said at least one photosensitive silver halide emulsion layer contains at least one cyan dye-forming coupler selected from the group consisting of compounds represented by the following general formula (I):

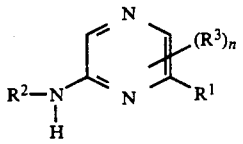

(I)

wherein $R^1$ represents an electron-donating group; $R^2$ represents a hydrogen atom, a substituted or an unsubstituted aliphatic group, a substituted or an unsubstituted aromatic group or a substituted or an unsubstituted heterocyclic group; $R^3$ represents a substitutent group; and n represents an integer of 0 to 2.

2. The silver halide color photographic material of claim 1, wherien the electron donating group is a group having a Hammett's substitutent constant of −0.25 or less.

3. The silver halide color photographic material of claim 1, wherein the electron donating group is a group having a Hammett's substituent constant of −0.50 or less.

4. The silver halide color photographic material of claim 2, wherein the electron donating group is a group having a Hammett's substituent constant of −0.90 or more.

5. The silver halide color photographic material of claim 2, wherein the group having a Hammett's constant of −0.25 or less is selected from the group consisting of substituted or unsubstituted amino groups, substituted or unsubstituted ureido groups, substituted or unsubstituted imino .group, substituted or unsubstituted alkoxy groups, a hydroxyl group substituted, unsubstituted hydrazino groups and substituted or unsubstituted heterocyclic group.

6. The silver halide color photographic material of claim 3, wherein the group having a Hammett's constant of −0.50 or less is selected from the group consisting of substituted or unsubstituted amino groups, substituted or unsubstituted imino groups and substituted or unsubstituted hydrazino groups.

7. The silver halide color photographic material of claim 5, wherein the substituent of the substituted amino group is selected from the group consisting of a substituted or unsubstituted alkyl group, a substituted or unsubstituted aryl group, or a hydroxyl group.

8. The silver halide color photographic material of claim 7, wherein the substituent of said substituted groups is selected from the group consisting of alkyl groups, alkoxy groups, aryloxy groups, alkenyloxy groups, amino groups, aliphatic or aromatic acyl groups, ester groups, amido groups, carbamoyl and thiocarbamoyl groups, thioureido groups, imido groups, ureido groups, aliphatic or aromatic sulfonyl groups, aliphatic or aromatic thio groups, a hydroxyl group, a cyano group, —COOM or —$SO_3M$ (M represents H, an alkali metal atom or $NH_4$), a nitro group, and halogen atoms.

9. The silver halide color photographic material of claim 5, wherein the substituent of the substituted ureido and hydrazino groups is selected from the group consisting of a substituted or unsubstituted alkyl groups and a substituted or unsubstituted aryl groups.

10. The silver halide color photographic material of claim 9, wherein the substituent of said substituted groups is selected from the group consisting of alkyl groups, alkoxy groups, aryloxy groups, alkenyloxy groups, amino groups, aliphatic or aromatic acyl groups, ester groups, amido groups, carbamoyl and thiocarbamoyl groups, thioureido groups, imido groups, ureido groups, aliphatic or aromatic sulfonyl groups, aliphatic or aromatic thio groups, a hydroxyl group, a cyano group, —COOM or —$SO_3M$ (M represents H, an alkali metal atom or $NH_4$), a nitro group, and halogen atoms.

11. The silver halide color photographic material of claim 5, wherein the substituent of the substituted imino group is selected from the group consisting of a substituted or unsubstituted alkilidene group, a substituted or unsubstituted arylidene group, and a substituted or unsubstituted cycloalkilidene group.

12. The silver halide color photographic material of claim 11, wherein the. substituent of said substituted groups is selected from the group consisting of alkyl groups, alkoxy groups, aryloxy grOups, alkenyloxy groups, amino groups, aliphatic or aromatic acyl groups, ester groups, amido groups, carbamoyl and thiocarbamoyl groups, thioureido groups, imido groups, ureido groups, aliphatic or aromatic sulfonyl groups, aliphatic or aromatic thio groups, a hydroxyl group, a cyano group, —COOM or —$SO_3M$ (M represents H, an alkali metal atom or $NH_4$), a nitro group, and halogen atoms.

13. The silver halide color photographic material of claim 5, wherein the substituent of the substituted alkoxy group or heterocyclic group is selected from the group consisting of alkyl groups, alkoxy groups, aryloxy groups, alkenyloxy groups, amino groups, aliphatic or aromatic acyl groups, ester groups, amido groups, carbamoyl and thiocarbamoyl groups, thioureido groups, imido groups, ureido groups, aliphatic or aromatic sulfonyl groups, aliphatic or aromatic thio groups, a hydroxyl group, a cyano group, —COOM or —$SO_3M$ (M represents H, alkali metal atom or $NH_4$), a nitro group, and halogen atoms.

14. The silver halide color photographic material of claim 1, wherein the substituent of the substituted aliphatic, aromatic or heterocyclic groups represented by $R^2$ is selected from the group consisting of alkyl groups, alkoxy groups, aryloxy groups, alkenyloxy grops, amino groups, aliphatic acyl groups, aromatic acyl groups, ester groups, amido groups, carbamoyl groups, thiocarbamoyl groups, thioureido groups, imido groups, ureido groups, aliphatic sulfonyl groups, aromatic sulfonyl groups, aliphatic thio groups, aromatic thio groups, a hydroxyl group, a cyano group, —COOM, —$SO_3M$ (M represents H, an alkali metal atom or $NH_4$), a nitro group, and halogen atoms; wherein the alkyl groups, alkoxy groups, aryloxy groups, alkenyloxy groups, amino groups, aliphatic acyl groups, aromatic acyl groups, ester groups, amido groups, carbamoyl groups, thiocarbamoyl groups, thioureido groups, imido groups, ureido groups, aliphatic sulfonyl groups, aromatic sulfonyl groups, aliphatic thio groups or aromatic thio groups, substituted on the aliphatic, aromatic, or heterocyclic groups represented by $R^2$ may be further substituted with at least one substituent group selected from the group consisting of alkyl groups, alkoxy groups, aryloxy groups, alkenyloxy groups, amino groups, aliphatic acyl groups, aromatic acyl groups, ester groups, amido groups, carbamoyl groups, thiocarbamoyl groups, thioureido groups, imido groups, ureido groups, aliphatic sulfonyl groups, aromatic sulfonyl groups, aliphatic thio groups, aromatic thio groups, a hydroxyl group, a cyano group, —COOM, —$SO_3M$ (M represents H, an alkali metal atom or $NH_4$), a nitro group, and halogen atoms.

15. The silver halide color photographic material of claim 1, wherein the heterocyclic grop is a 5- to 6-membered ring having at least one of N, O and S atoms as a hetero atom.

16. The silver halide color photographic material of claim 15, wherein the heterocyclic group is selected from the group consisting of a 3-puridyl group, a 2-furyl group, a 2-pyrrolyl group and a 2-thienyl group.

17. The silver halide color photographic material of claim 1, wherein $R^3$ represents a halogen atom, an aliphatic group, an aromatic group, a heterocyclic group, an alkoxy group, an aryloxy group, an alkenyloxy group, an amino group, an acyl group, an ester group, an amido group, a thioureido group, an imido group, an ureido group, an aliphatic or aromatic sulfonyl group, an aliphatic or aromatic oxycarbonyloxy group, an aromatic azo group, an aliphatic, an aromatic or heterocyclic thio group, substituted. groups of these groups, a hydroxyl group, a cyano group, —COOM or —$SO_3M$ (M represens H, an alkali metal atom or $NH_4$), or a nitro group.

18. The silver halide color photographic material of claim 17, wherein the substituent of said substituted groups is selected from the group consisting of alkyl group, alkoxy groups, aryloxy groups, alkenyloxy groups, amino groups, aliphatic or aromatic acyl groups, ester groups, amido groups, carbamoyl and thiocarbamoyl groups, thioureido groups, imido groups, ureido groups, aliphatic or aromatic sulfonyl groups, aliphatic or aromatic thio groups, a hydroxyl group, a cyano group, —COOM or —$SO_3M$ (M represents H, an alkali metal atom or $NH_4$), a nitro group, and halogen atoms.

19. The silver halide color photographic material of claim 1, wheren $R^3$is a hydrogen atom or a group which is eliminable by a coupling reaction with an oxidation product of a developing agent when $R^3$ is substituted at the position marked with * in the following general formula

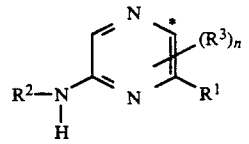

wherein $R^1$ and $R^2$ are as defined in claim 1.

20. The silver halide color photographic material of claim 1, wherein the couplers represented by general formula (I) are further preferably represented by general formula (II):

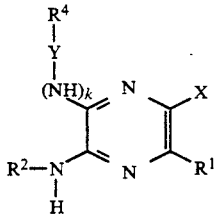

(II)

wherein $R^1$ and $R^2$ have the same meaning as given in general formula (I); k represents 0 or 1; Y represents —CO—or —$SO_2$—; $R^4$ represents a hydrogen atom, an aliphatic group, an aromatic group, a heterocyclic group, an amino group, an aliphatic amino group, an aromatic amino group, an aliphatic oxy group or an aromatic oxy group or substituted groups of these groups; and X represents a hydrogen atom or a group which is eliminable by coupling reaction with an oxidation product of a developing agent.

21. The silver halide color photographic material of claim 20, wherein $R^4$ represents a hydrogen atom, an aliphatic group having 1 to 36 carbon atoms, an aromatic group having 6 to 36 carbon atoms, a heterocyclic group selected from the group consisting of 3-pyridyl and 2-furyl, an amino group, an aliphatic oxy group or an aromatic oxy group.

22. The silver halide color photographic material of claim 21, wherein the amino group is an aliphatic amino group or an aromatic amino group.

23. The silver halide color photographic material of claim 1, wherein the coupler of formula (I) is selected from the group consisting of formulas (1)–(24);

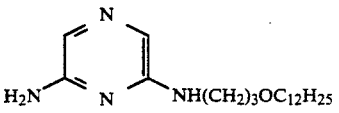

(1)

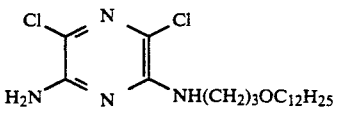

(2)

-continued
(3)
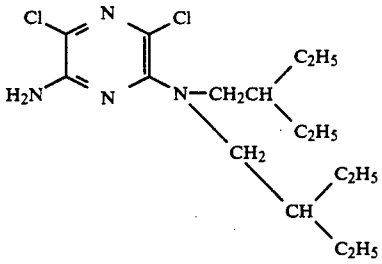
(4)
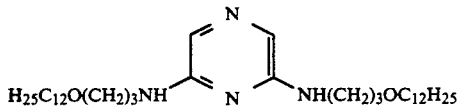
(5)
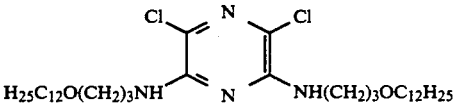
(6)
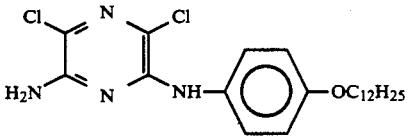
(7)
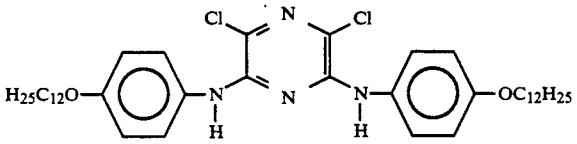
(8)
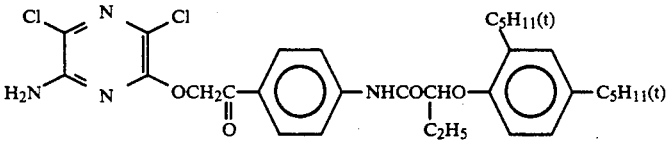
(9)
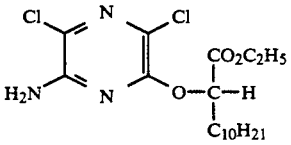
(10)
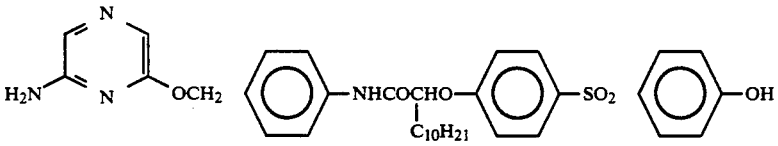
(11)
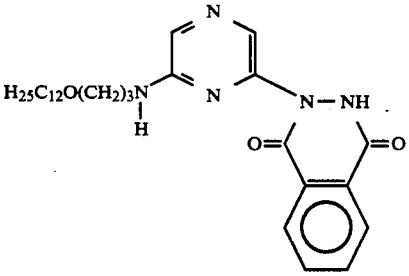
(12)
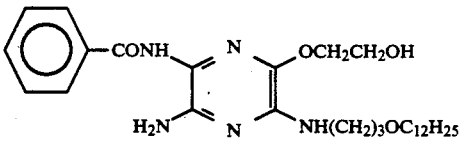
(13)
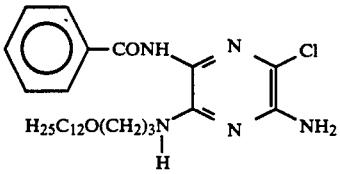
(14)
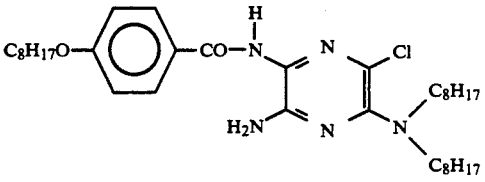

-continued (15)

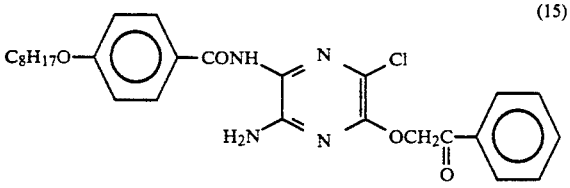

(16)

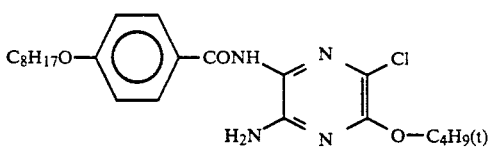

(17)

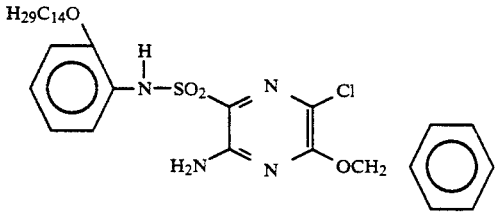

(18)

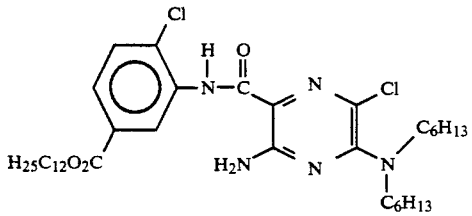

(19)

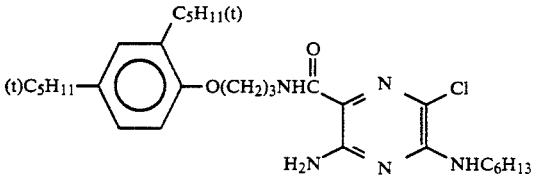

(20)

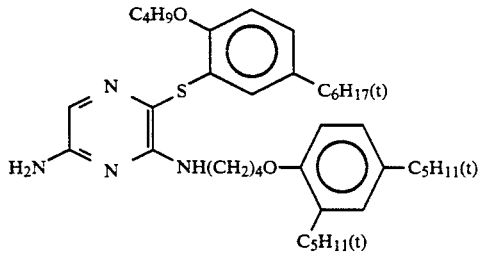

(21)

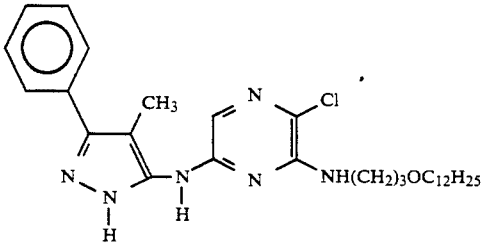

(22)

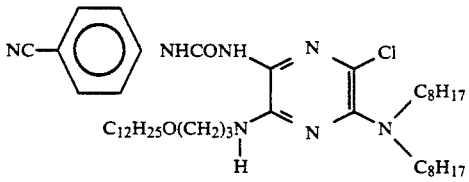

(23)

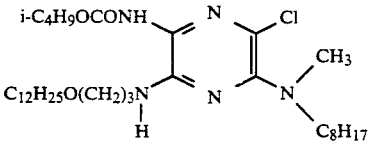

(24)

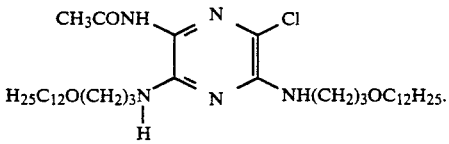

24. The silver halide color photographic material of claim 1, wherein said coupler is present in an amount of 0.01 to 5 mmol per square meter of the photographic material.

25. The silver halide color photographic material of claim 1, wherein said coupler is incorporated to a photographic material using a high boiling organic solvent selected from phthalates, aliphatic esters, chlorinated paraffins, phenols, and carboxylic acids.

26. The silver halide color photographic material of claim 1, wherein $R^2$ represents a hydrogen atom, an aliphatic group having 1 to 36 carbon atoms, an aromatic group having 6 to 36 carbon atoms or a heterocyclic group selected from the group consisting of a 3-pyridyl group, a 2-furyl group, a 2-pyrrolyl group, a 2-thienyl group, a morpholino group, a piperidino group and

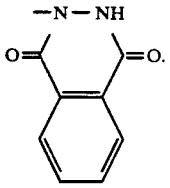

* * * * *